US010820397B1

(12) United States Patent
Chilukuri et al.

(10) Patent No.: US 10,820,397 B1
(45) Date of Patent: Oct. 27, 2020

(54) TEST ARCHITECTURE FOR LIGHT EMITTING DIODE ARRAYS

(71) Applicant: Facebook Technologies, LLC, Menlo Park, CA (US)

(72) Inventors: Ramakrishna Chilukuri, San Jose, CA (US); Salman Mazhar, Redmond, WA (US); Ilias Pappas, Cork (IE); William Thomas Blank, Bellevue, WA (US); Michael Yee, Kirkland, WA (US)

(73) Assignee: FACEBOOK TECHNOLOGIES, LLC, Menlo Park, CA (US)

( * ) Notice: Subject to any disclaimer, the term of this patent is extended or adjusted under 35 U.S.C. 154(b) by 0 days.

(21) Appl. No.: 16/689,368

(22) Filed: Nov. 20, 2019

(30) Foreign Application Priority Data

Apr. 15, 2019 (GR) ..... 20190100169

(51) Int. Cl.
*H05B 47/21* (2020.01)
*H05B 45/37* (2020.01)
*H05B 47/18* (2020.01)

(52) U.S. Cl.
CPC ..... *H05B 47/21* (2020.01); *H05B 45/37* (2020.01); *H05B 47/18* (2020.01)

(58) Field of Classification Search
None
See application file for complete search history.

(56) References Cited

U.S. PATENT DOCUMENTS

| | | | | |
|---|---|---|---|---|
| 7,052,180 | B2 * | 5/2006 | Shih | G01K 7/01 374/1 |
| 8,508,525 | B2 * | 8/2013 | Komiya | G09G 3/3233 345/211 |
| 9,414,460 | B2 * | 8/2016 | Bender | H05B 45/50 |
| 10,334,690 | B1 * | 6/2019 | Hsu | H05B 45/46 |
| 2011/0089855 | A1 * | 4/2011 | Roberts | H05B 45/10 315/291 |

* cited by examiner

*Primary Examiner* — Minh D A
*Assistant Examiner* — James H Cho
(74) *Attorney, Agent, or Firm* — Weaver Austin Villeneuve & Sampson LLP

(57) ABSTRACT

Apparatuses and methods are presented relating to a plurality of current sources for generating a plurality of first bias currents to drive a plurality of LEDs and a plurality of measurement circuits for obtaining a plurality of first voltage measurements for the LEDs during a first test cycle. The current sources are further configurable to generate a plurality of second bias currents for driving the LEDs, and the measurement circuits are further configurable to obtain a plurality of second voltage measurements for the plurality of LEDs, during a second test cycle. A memory device is configured to store the first and second bias currents and first and second voltage measurements as a current-voltage (I-V) performance characteristic.

18 Claims, 29 Drawing Sheets

1800

TEST ARCHITECTURE FOR LIGHT EMITTING DIODE ARRAYS

CROSS-REFERENCE TO RELATED APPLICATION

This application claims priority under 35 U.S.C. § 119 to Greece Provisional Patent Application No. 20190100169, filed on Apr. 15, 2019, the contents of which are hereby incorporated by reference in their entirety for all purposes.

BACKGROUND

Aspects of the disclosure relate to testing of the performance of light emitting diodes (LEDs) in an LED array. The spatial location of an individual LED may affect its performance as the LED array is used. Some related art methods test LEDs in an LED array by applying an external probe to individual LEDs within the LED array. However, these methods are time-consuming and may be limited to testing one LED at a time.

SUMMARY

The present disclosure generally relates to testing characteristics of LEDs within an array of LEDs. According to an aspect of the invention, an apparatus includes a plurality of controllable current sources configurable to generate, in parallel, a plurality of first bias currents, each of a known magnitude, for driving a plurality of light emitting diodes (LEDs) during a first test cycle. The apparatus also includes a plurality of measurement circuits configurable to obtain a plurality of first voltage measurements, each indicative of a voltage measurement at one of the plurality of LEDs during the first test cycle. The plurality of controllable current sources are further configurable to generate, in parallel, a plurality of second bias currents, each of a known magnitude, for driving the plurality of LEDs during a second test cycle. The plurality of measurement circuits are further configurable to obtain a plurality of second voltage measurements, each indicative of a voltage measurement at one of the plurality of LEDs during the second test cycle. The apparatus also includes a memory device for storing the plurality of first bias currents, the plurality of first voltage measurements, the plurality of second bias currents, and the plurality of second voltage measurements as a current-voltage (I-V) performance characteristic for the plurality of LEDs. The plurality of LEDs are part of a two-dimensional array of LEDs.

The plurality of controllable current sources may form a part of a driving circuit backplane, and the two-dimensional array of LEDs may be mountable to the driving circuit backplane. The plurality of measurement circuits may be implemented within the driving circuit backplane. Alternatively, the plurality of measurement circuits may be implemented outside of the driving circuit backplane and outside of an active array circuit containing the two-dimensional array of LEDs.

Each of the plurality of measurement circuits may include a buffer and an analog-to-digital converter (ADC). Alternatively, each of the plurality of measurement circuits comprises a buffer, a comparator, and a digital-to-analog converter (DAC).

The apparatus may also include one or more multiplexers, which may be configured to selectively connect the plurality of controllable current sources and the plurality of measurement circuits to selected LEDs in the two-dimensional array of LEDs. Alternatively or in addition, the apparatus may also include a serial peripheral interface (SPI) controller for controlling operations of the plurality of controllable current sources and the plurality of measurement circuits.

The apparatus may also include a plurality of switch transistors. Each of the plurality of LEDs may be connected to a respective one of the plurality of switch transistors. Further, each of the plurality of measurement circuits is connected to at least one of the plurality of switch transistors.

Alternatively, each of a first subset of the plurality of LEDs may be connected to a respective one of the plurality of switch transistors, and each of a second subset of the plurality of LEDs may be disconnected from a respective one of the plurality of switch transistors. Further, each of the plurality of measurement circuits may be connected to at least one of the first subset of the plurality of LEDs. Each of the plurality of measurement circuits may be arranged at a source node of a transistor of a respective one of the plurality of controllable current sources.

The apparatus may also include a light sensor that is configured to obtain a plurality of first luminance measurements from the plurality of LEDs during the first test cycle, and to obtain a plurality of second luminance measurements from the plurality of LEDs during the second test cycle. The memory device may be further configured to store the plurality of first luminance measurements, the plurality of first voltage measurements, the plurality of second luminance measurements, and the plurality of second voltage measurements as a luminance-voltage (LI-V) performance characteristic for the plurality of LEDs. The apparatus may also include a controller that is configured to generate a first trigger signal for the plurality of controllable current sources to generate the plurality of first bias currents for driving the plurality of LEDs during the first test cycle. The first trigger signal may be generated as a function of a location of the light sensor with respect to the plurality of LEDs.

One of the plurality of controllable current sources may be configured to generate one of the plurality of first bias currents for driving a subset of the plurality of LEDs during the first test cycle, and to generate one of the plurality of second bias currents for driving the subset of the plurality of LEDs during the second test cycle. Alternatively or in addition, one of the plurality of controllable current sources may be configured to generate a third bias current of a known magnitude for driving each of a subset of the plurality of LEDs in sequence. The apparatus may also include a port that is configured to receive a start address and a stop address for the plurality of LEDs.

Other objects, advantages, and novel features of the present invention will become apparent from the following detailed description of the invention when considered in conjunction with the accompanying drawings.

DETAILED DESCRIPTION

Figure 1:
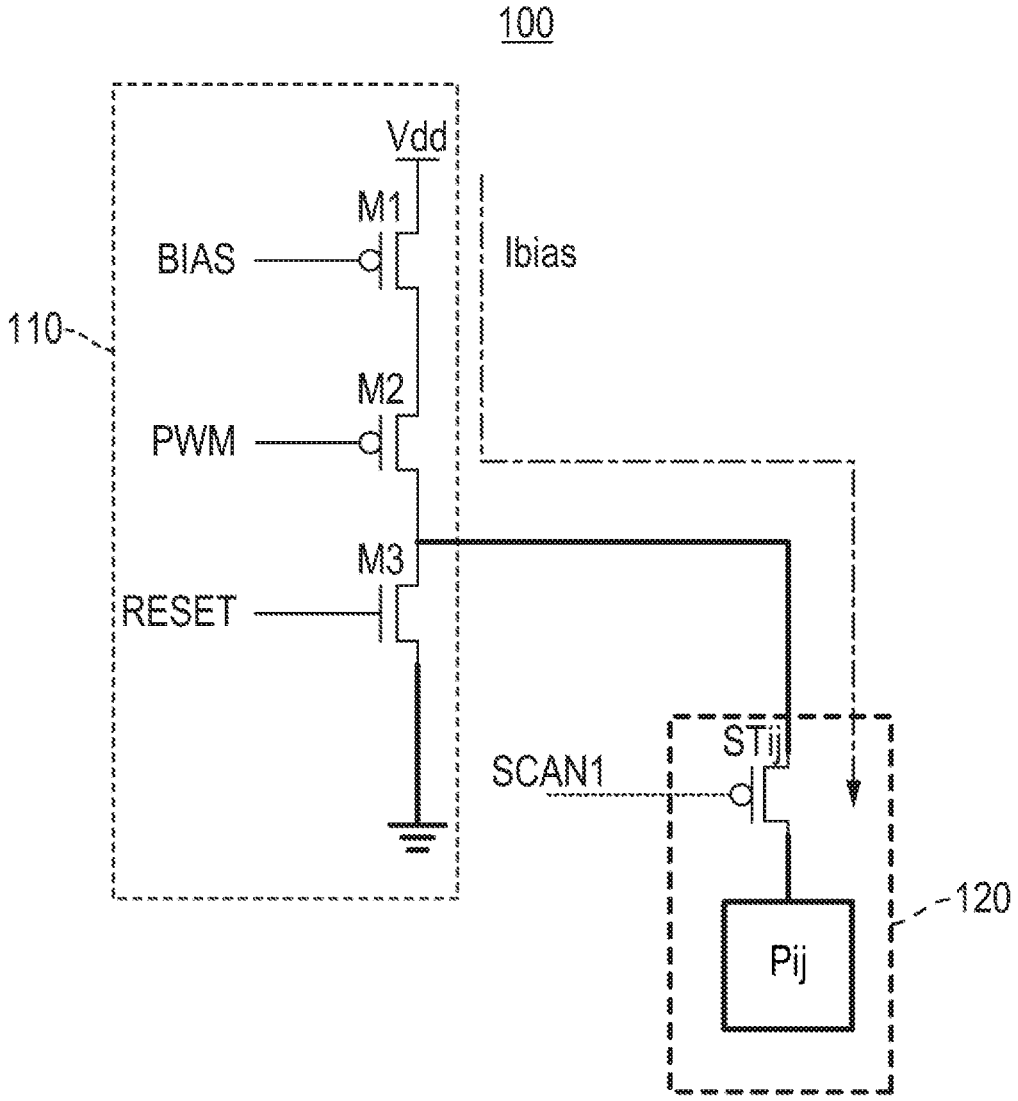
FIG. 1 illustrates a pixel being driven using an example of a Normal Driver Architecture, according to an embodiment of the present disclosure.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

Embodiments of the invention collect current-voltage (I-V) characteristics and/or luminance-voltage (LI-V) characteristics from LEDs within an LED array. The LEDs that are tested may be arranged at an interior region of the LED array. Alternatively or in addition, the LEDs that are tested may be arranged at a peripheral region of the LED array. More generally, a single LED may be tested, a subset of the LEDs may be tested, or all of the LEDs may be tested. The LEDs may be micro-LEDs. Micro-LED or μLED may refer to an LED having a chip with a linear dimension that is less than about 200 μm, such as less than 100 μm, less than 50 μm, less than 20 μm, less than 10 μm, or smaller. For example, the linear dimension of a micro-LED may be as small as 6 μm, 5 μm, 4 μm, 2 μm, or smaller.

The I-V and/or LI-V characteristics may be used to design an LED array for an AR display. As discussed in further detail below, a Test Driver Architecture may utilize a backplane dedicated to testing and characterization purposes. According to various embodiments of the present disclosure, such a test backplane may not be used to build an AR display. Instead, the test backplane may be driven in a manner similar to how it would be used in an AR display, and then characterized according to the methods discussed below. In other embodiments, the Test Driver Architecture may be used within a functioning AR display. The Test Driver Architecture backplane may be based on a previous Normal Driver Architecture backplane with some modifications to perform measurements on the LEDs of the Active Array. A driving circuit may apply a well-controlled and known current to the LEDs and measure their corresponding forward voltage and/or luminance. In some examples, a current-voltage (I-V) curve may be measured for an entire 1920×1080 LED array in a matter of seconds, such as less than 10 seconds. Furthermore, many LEDs may be measured in parallel in order to minimize the needed measurement time.

Normal Driver Architecture

Several illustrative embodiments will now be described with respect to the accompanying drawings, which form a part hereof. While particular embodiments, in which one or more aspects of the disclosure may be implemented, are described below, other embodiments may be used and various modifications may be made without departing from the scope of the disclosure or the spirit of the appended claims.

FIG. 1 illustrates a pixel being driven using an example of a Normal Driver Architecture 100, according to an embodiment of the disclosure. The Normal Driver Architecture 100 is an illustrative architecture for providing driving current to LEDs in an LED array under normal operating conditions. For example, normal operations may include operation of an AR/VR device by a user. FIG. 1 shows that the Normal Display Architecture 100 may include two main groupings of devices and circuitry: (1) a Display Driver Integrated Circuit (DDIC) 110 and (2) an Active Array 120. The DDIC refers to display driver circuitry that provides driving current to the LEDs in the Active Array. The term "DDIC," as used in the present disclosure, does not necessarily refer to a separate integrated circuit that is apart from the Active Array. In fact, the DDIC and the Active Array may be bonded together, forming a monolithic integrated circuit chip. The DDIC 110 is a controllable current source that provides bias current Ibias to the Active Array 120. As shown in FIG. 1, the DDIC 110 may include three transistors M1, M2, and M3. Transistor M1 controls the bias current Ibias, transistor M2 controls the pulse width modulation (PWM) pulses, and transistor M3 is used for reset. A drive voltage Vdd is used to drive the DDIC 110, which is connected to ground at the source node of transistor M3. The Active Array 120 includes a multi-dimensional array of LEDs, such as a 2D array of LEDs. The LEDs may be micro-LEDs. Each micro-LED Pij is connected to a respective switch transistor STij to form a pixel. While FIG. 1 shows only a single pixel, a separate LED Pij and corresponding switch transistor STij may be provided within the Active Array 120 to form a plurality of pixels. In one example, an Active Array 120 including 1080×1920 LEDs may be implemented. For ease of explanation, one dimension may be referred to as "columns," and the other dimension may be referred to as "rows," even though the labels "columns" and "rows" may be interchanged, and they do not necessarily dictate the orientation of the Active Array 120. In this example, there may be 1080 columns and 1920 rows. In other examples, there may be a different number of columns and/or rows. A display may include three Active Arrays 120, such that one Active Array 120 is provided for each of three colors, such as red, green, and blue.

According to various embodiments, multiple LEDs in each row of LEDs may be driven in parallel at any given time. One row may be driven sequentially after another row is driven. Thus, in the 1080×1920 example, the Normal Driver Architecture backplane may provide the driving currents to the 1080 LEDs in a particular row simultaneously. This may be achieved by use of scan line signals. For example, referring to FIG. 1, the "SCAN 1" signal may be turned on to direct the driving current Ibias for the present column, coming from the DDIC 110, to the particular LED in the present row. At the same time, other scan line signals (e.g., "SCAN 2," SCAN 3," etc.) may be turned off so as to disconnect other LEDs in the same column from the driving current Ibias. Alternatively, the Normal Driver Architecture backplane may provide the driving currents to 54 of the 1080 LEDs in a particular row simultaneously, and then use a multiplexer with a 20:1 switch to change the LEDs that are being driven. The 20:1 switch allows all 1080 LEDs in a row to be driven by the 54 driving currents, because 20×54=1080. The rows may then be tested one at a time. In other examples, the Normal Driver Architecture Backplane may provide a different number of driving currents to the 1080 LEDs in a row and use a multiplexer having a different switch ratio. For example, a 27:1 switch allows all 1080 LEDs in a row to be driven by 27 driving currents, because 27×40=1080. In other examples, there may be other numbers of driving currents, as long as the number of columns is evenly divisible by the number of driving currents to obtain the switch ratio of the multiplexer. The number of available current sources (108, 54 or 27, for example) dictates how many LEDs in a row may be driven/turned on and measured simultaneously. This number may be configurable/programmable. The greater the number of simultaneous measurements, the shorter the overall measurement time.

As discussed, the DDIC 110 may either be a separate integrated circuit chip apart from the Active Array 120 or may be integrated with the array itself. When the DDIC 110 and the Active Array 120 are built separately, they may be bonded together, forming a monolithic integrated circuit chip. Various embodiments of the interconnection between the DDIC 110 and the Active Array 120 are possible. The Active Array 120 may have two opposite sides, i.e., a light-emitting side and a contact side. Each LED Pij may be formed from an epitaxial layered structure and have a P-contact and an N-contact by which a current may be applied to activate the LED Pij. The LED Pij may be arranged to emit light on the light-emitting side, while having its P-contact and N-contact exposed on the contact side of the Active Array 120. The contact side of the Active Array 120 may be bonded, e.g., using metal bumps or by other means, to a backplane that includes the DDIC 110. Such a backplane may be referred to as the DDIC backplane and may be implemented using, for example, a CMOS-based integrated circuit technology. According to one embodiment, the Active Array 120 and the DDIC backplane, bonded together, forms a single LED integrated chip. Multiple ones of such LED integrated chips may be combined to form a display.

Test Driver Architecture

Figure 2:
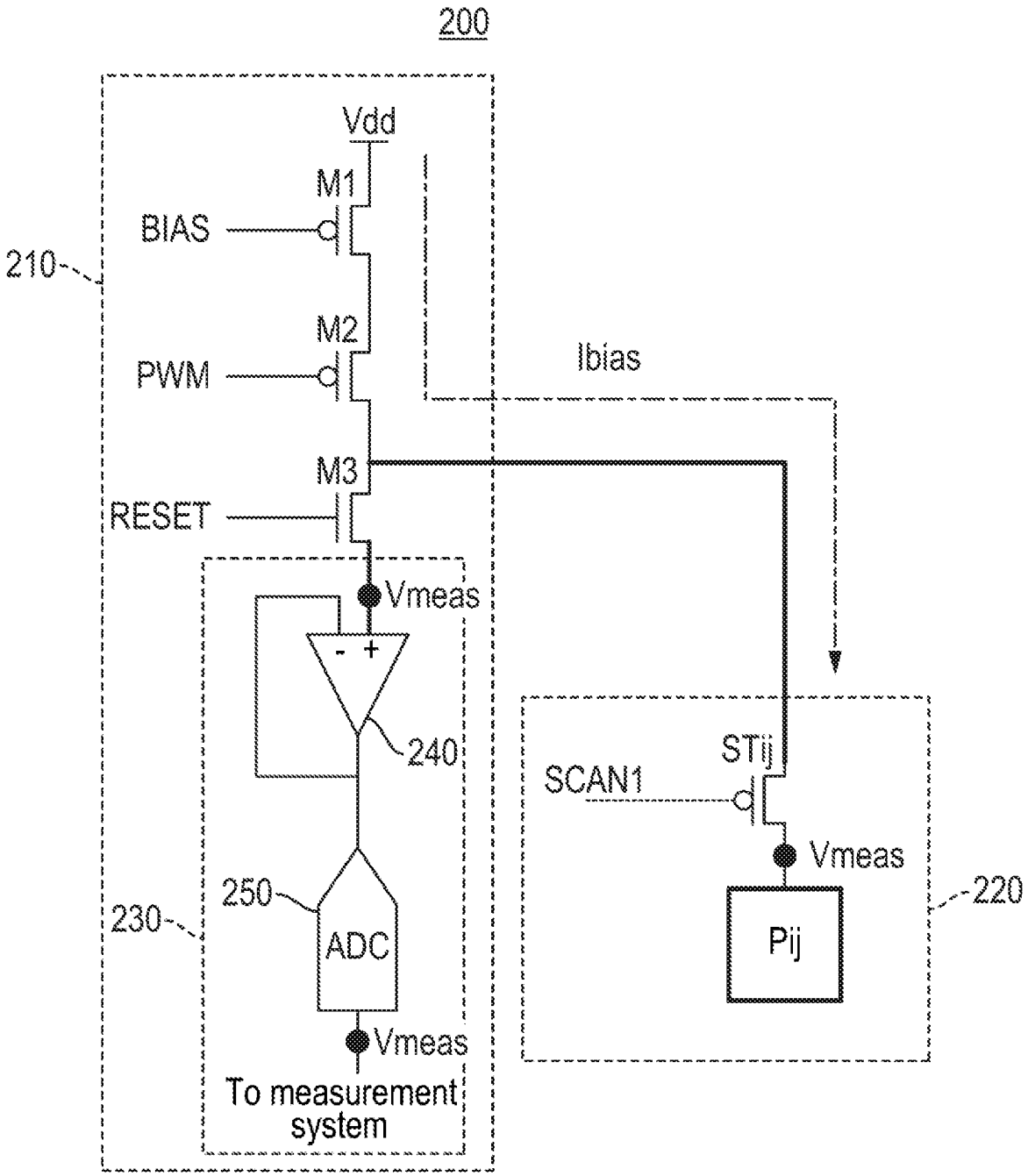
FIG. 2 illustrates a first approach to the Test Driver Architecture, according to an embodiment of the disclosure.

FIG. 2 illustrates a first approach to the Test Driver Architecture 200, according to an embodiment of the disclosure. The Test Driver Architecture 200 is an illustrative architecture for testing the performance of LEDs in an LED array under test conditions. As shown in FIG. 2, the Test Driver Architecture 200 may be based on the Normal Driver Architecture 100, and may include a DDIC 210 and an Active Array 220. The first approach of the Test Driver Architecture 200 leaves the Active Array 220 as-is in the Normal Driver Architecture 100 and modifies the DDIC 210. As shown in FIG. 2, a measurement circuit 230 is added to the DDIC 210 to replace the ground at the source node of transistor M3. The measurement circuit 230 includes a buffer 240 and an Analog-to-Digital Converter (ADC) 250. The current bias circuit may operate the same as in the Normal Driver Architecture 100.

An example of the measurement procedure is as follows: the bias current Ibias is applied to the LED Pij through the switch transistor STij, and the SCAN1 signal enables the measurement circuit 230 to sense the voltage Vmeas at the input to the buffer 240, which may be assumed to be close to the voltage Vmeas of the LED Pij. For example, the voltage Vmeas at the input to the buffer 240 may be equal to the voltage Vmeas of the LED Pij, or may be different from the voltage Vmeas of the LED Pij by a few mV. In this way a data pair including the bias current Ibias and the voltage Vmeas can be obtained. Then the bias current Ibias is increased and the voltage Vmeas is measured again. In this way, the entire I-V curve can be collected. In one example, the maximum bias current Ibias is 6 μA and the minimum current step for the bias current Ibias is 63 nA, giving roughly 100 current points for measurement. The measurement circuit 230 outputs a digital representation of the voltage Vmeas to a measurement system, such as the electronics 1020 described below with regard to FIG. 10, which collects, processes, and saves the voltage measurements. The measurement system may include a memory device for storing each bias current Ibias and voltage Vmeas as a data pair, thereby forming an I-V curve for the LED Pij.

Additionally or alternatively, a luminance-voltage (LI-V) curve may be measured for the LED Pij. An external light sensor, such as a luminance meter, may be used to measure the luminance from the LED Pij. The voltage Vmeas may be measured as a function of the bias current Ibias as described above, and the luminance may be measured simultaneously by the external light sensor. The memory device may store an LI-V curve that includes a plurality of data pairs, each of which includes a measurement of the luminance and a measurement of the voltage Vmeas.

The Test Driver Architecture shown in FIG. 2 may be used to test each LED Pij within the Active Array 220 sequentially. For example, the measurement circuit 230 may be connected to each LED Pij, and the transistor M1 provides the bias current Ibias to each LED Pij. The SCAN1 signal activates the LEDs Pij in turn. The testing may start and stop at any of the LEDs Pij. Further, the testing may proceed in a forward direction or a backward direction, which may be useful in determining whether the order of testing has any impact on the results. A single LED Pij may be measured, a subset of the LEDs Pij may be measured, or all of the LEDs Pij may be measured. If an LI-V curve is measured, a controller associated with the external light sensor may control the SCAN1 signal to activate an LED Pij after the external light sensor has been aligned to receive light from the LED Pij. The external light sensor may be moved over various areas of the LED array by a mechanical stepper that is operated by the controller.

Figure 3:
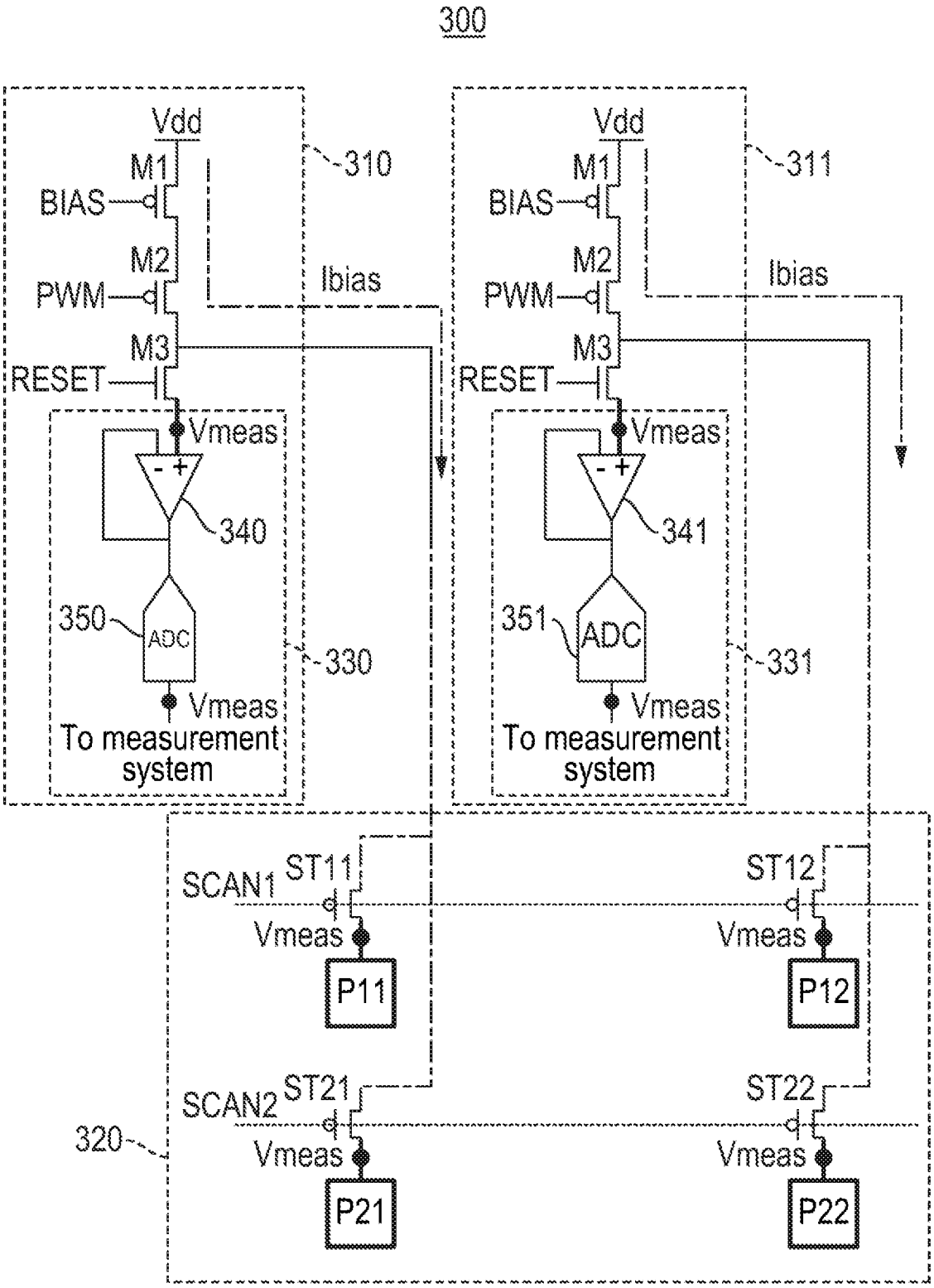
FIG. 3 illustrates a second approach to the Test Driver Architecture, similar to that shown in FIG. 2, but scaled up to two columns and two rows, according to an embodiment of the disclosure.

FIG. 3 illustrates a second approach to the Test Driver Architecture 300, similar to that shown in FIG. 2, but with an additional DDIC, according to an embodiment of the disclosure. As shown in FIG. 3, the Test Driver Architecture 300 may include a first DDIC 310, a second DDIC 311, and an Active Array 320. A first measurement circuit 330 is added to the first DDIC 310 to replace the ground at the source node of transistor M3. The first measurement circuit 330 includes a first buffer 340 and a first ADC 350. Similarly, a second measurement circuit 331 is added to the second DDIC 311 to replace the ground at the source node of transistor M3. The second measurement circuit 331 includes a second buffer 341 and a second ADC 351.

The Active Array 320 includes a first pixel having a first LED P11 that is connected to a first switch transistor ST11, a second pixel having a second LED P21 that is connected to a second switch transistor ST21, a third pixel having a third LED P12 that is connected to a third switch transistor ST12, and a fourth pixel having a fourth LED P22 that is connected to a fourth switch transistor ST22. The first DDIC 310 may be used to measure the voltage Vmeas of the first LED P11 and the second LED P21, while the second DDIC 311 may be used to measure the voltage Vmeas of the third LED P12 and the fourth LED P22.

An example of the measurement procedure is as follows: the bias current Ibias is applied to the first LED P11 and the second LED P21 by transistor M1 within the first DDIC 310, and the bias current Ibias is applied to the third LED P12 and the fourth LED P22 by transistor M1 within the second DDIC 311. The SCAN1 signal enables only one row for measurement, including the first LED P11 and the third LED P12. An I-V curve is obtained for the first LED P11 by the first measurement circuit 330, and an I-V curve is obtained for the third LED P12 by the second measurement circuit 331. Similarly, the SCAN2 signal then enables another row for measurement, including the second LED P21 and the fourth LED P22. An I-V curve is obtained for the second LED P21 by the first measurement circuit 330, and an I-V curve is obtained for the fourth LED P22 by the second measurement circuit 331.

The Test Driver Architecture shown in FIG. 3 may be used to test various LEDs within the Active Array 320 in parallel. As will be explained in more detail later, in one embodiment, "all the pixels" being tested may refer to all the pixels in the enabled row, e.g., 1080 pixels or any other suitable number of pixels. In another embodiment, "all the pixels" being tested may refer to only a subset of the pixels in the enabled row, e.g., 54 out of 1080 pixels or any other suitable subset of the pixels. Further, a separate DDIC may be provided for each column or for different groupings of columns. For example, if a separate DDIC is provided for each column, then all of the pixels in a particular row may be tested at the same time. When all of the pixels in one row have been measured, the next row may be enabled, and all of the pixels in the next row may be measured. In order for the Test Driver Architecture to function as a display, a separate DDIC would be provided for each column.

Figure 4:
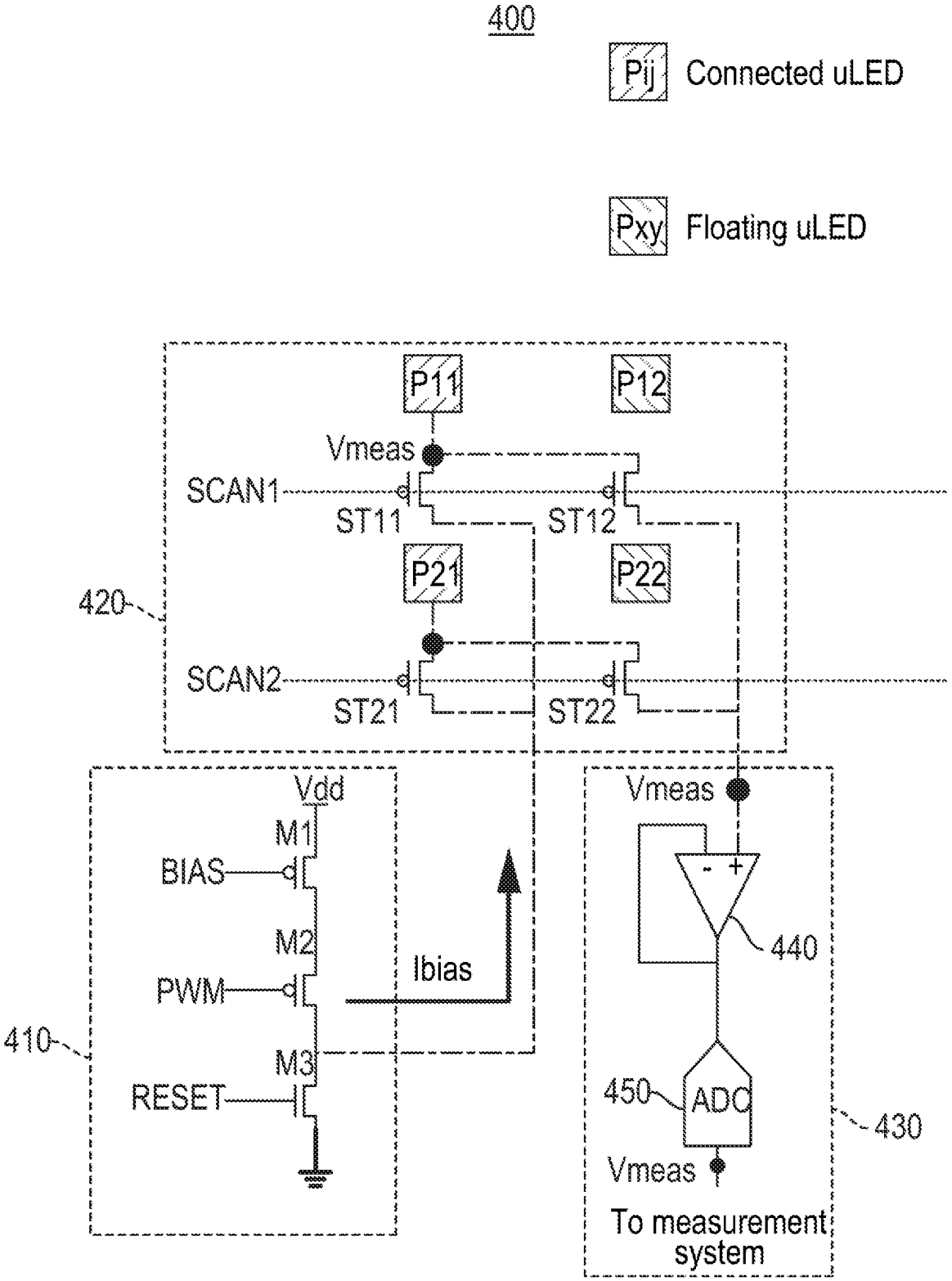
FIG. 4 illustrates a third approach to the Test Driver Architecture, according to an embodiment of the disclosure.

FIG. 4 illustrates a third approach to the Test Driver Architecture 400, according to an embodiment of the disclosure. As shown in FIG. 4, the Test Driver Architecture 400 may include a DDIC 410 and an Active Array 420. A measurement circuit 430 is added after the Active Array 420. The measurement circuit 430 includes a buffer 440 and an ADC 450.

The Active Array 420 includes a first pixel having a first LED P11 that is connected to a first switch transistor ST11, a second pixel having a second LED P21 that is connected to a second switch transistor ST21, a third pixel having a third LED P12 that is not connected to a third switch transistor ST12, and a fourth pixel having a fourth LED P22 that is not connected to a fourth switch transistor ST22.

In this configuration, the first column contains connected LEDs P11 and P21, and the second column contains floating LEDs P12 and P22. The switch transistor (controlled by one of the SCAN signals) of each floating pixel is connected to the neighbor connected pixel. For example, the second switch transistor ST12 is connected to the first pixel. The DDIC 410 is connected to the first column and the measurement circuit 430 is connected to the second column. The measurement procedure may be the same as described in the first approach. A scan signal selects which row will be measured and the DDIC of the connected column sets the bias current Ibias of the LEDs. The additional circuitry of the neighbor floating column measures the corresponding voltage Vmeas and in this way the pair I-V is obtained. Note that for this configuration, the measured voltage Vmeas is identical to the voltage across the connected LED. Due to the floating column, only half of the LEDs of the Active Array 420 can be measured.

Figure 5:
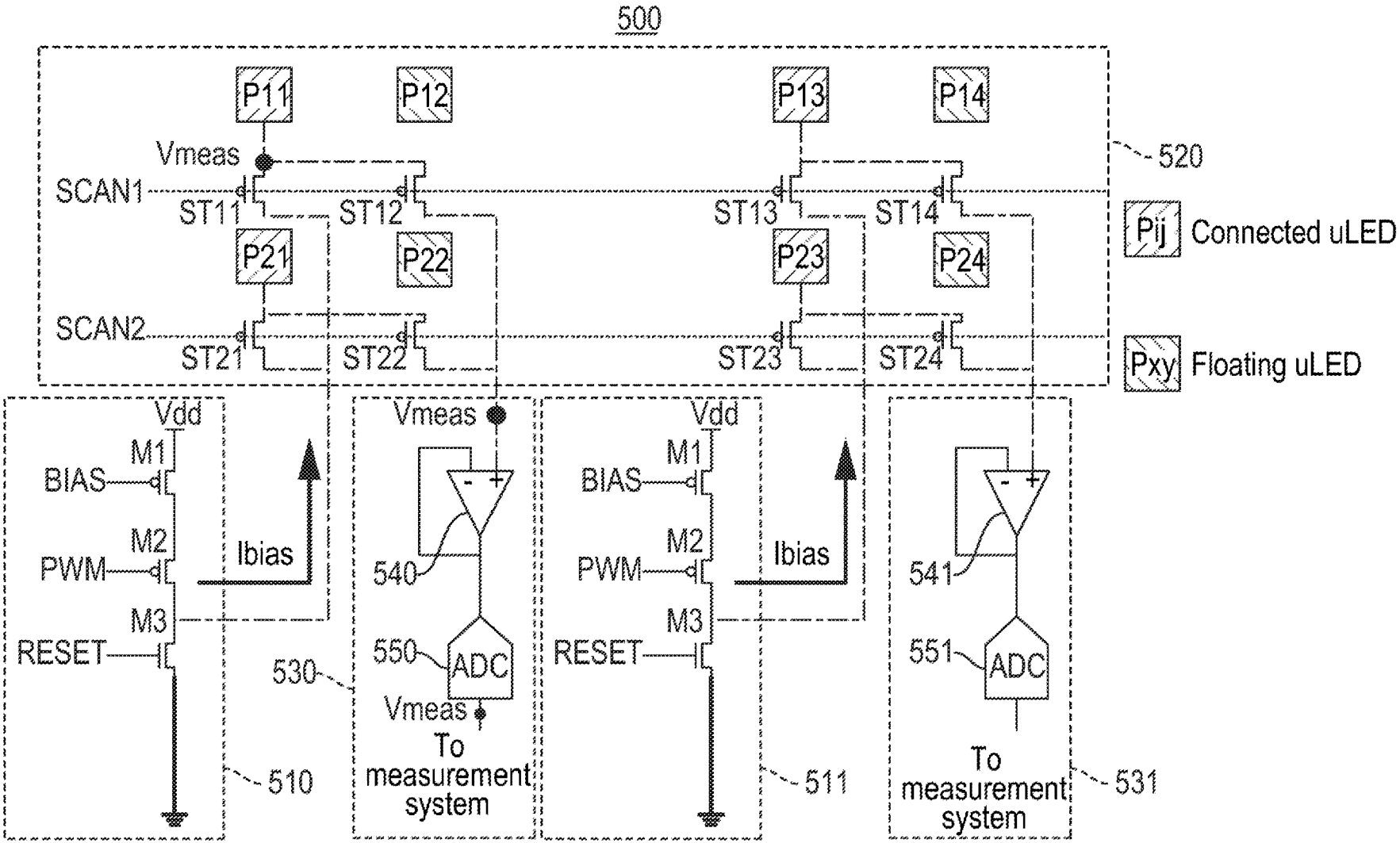
FIG. 5 illustrates a fourth approach to the Test Driver Architecture, similar to that shown in FIG. 4, but scaled up to four columns and two rows, according to an embodiment of the disclosure.

FIG. 5 illustrates a fourth approach to the Test Driver Architecture 500, similar to that shown in FIG. 4, but scaled up to four columns and two rows, according to an embodiment of the disclosure. As shown in FIG. 5, the Test Driver Architecture 500 may include a first DDIC 510, a first measurement circuit 530, a second DDIC 511, a second measurement circuit 531, and an Active Array 520. The first DDIC 510 includes transistors M1, M2, and M3, and the first measurement circuit 530 includes a first buffer 540 and a first ADC 550. Similarly, the second DDIC 511 includes transistors M1, M2, and M3, and the second measurement circuit 531 includes a second buffer 541 and a second ADC 551. The Active Array 520 includes a first pixel having a first LED P11 that is connected to a first switch transistor ST11, a second pixel having a second LED P21 that is connected to a second switch transistor ST21, a third pixel having a third LED P12 that is not connected to a third switch transistor ST12, a fourth pixel having a fourth LED P22 that is not connected to a fourth switch transistor ST22, a fifth pixel having a fifth LED P13 that is connected to a fifth switch transistor ST13, a sixth pixel having a sixth LED P23 that is connected to a sixth switch transistor ST23, a seventh pixel having a seventh LED P14 that is not connected to a seventh switch transistor ST14, and an eighth pixel having an eighth LED P24 that is not connected to an eighth switch transistor ST24.

In this configuration, there are four columns and two rows. The first column contains the connected LEDs P11 and P21, the second column contains the floating LEDs P12 and P22, the third column contains the connected LEDs P13 and P23, and the fourth column contains the floating LEDs P14 and P24. The switch transistor (controlled by one of the SCAN signals) of each floating pixel is connected to the neighbor connected pixel. For example, the second switch transistor ST12 is connected to the first pixel. The measurement procedure may be the same as described above with respect to FIG. 4.

Figure 6A:
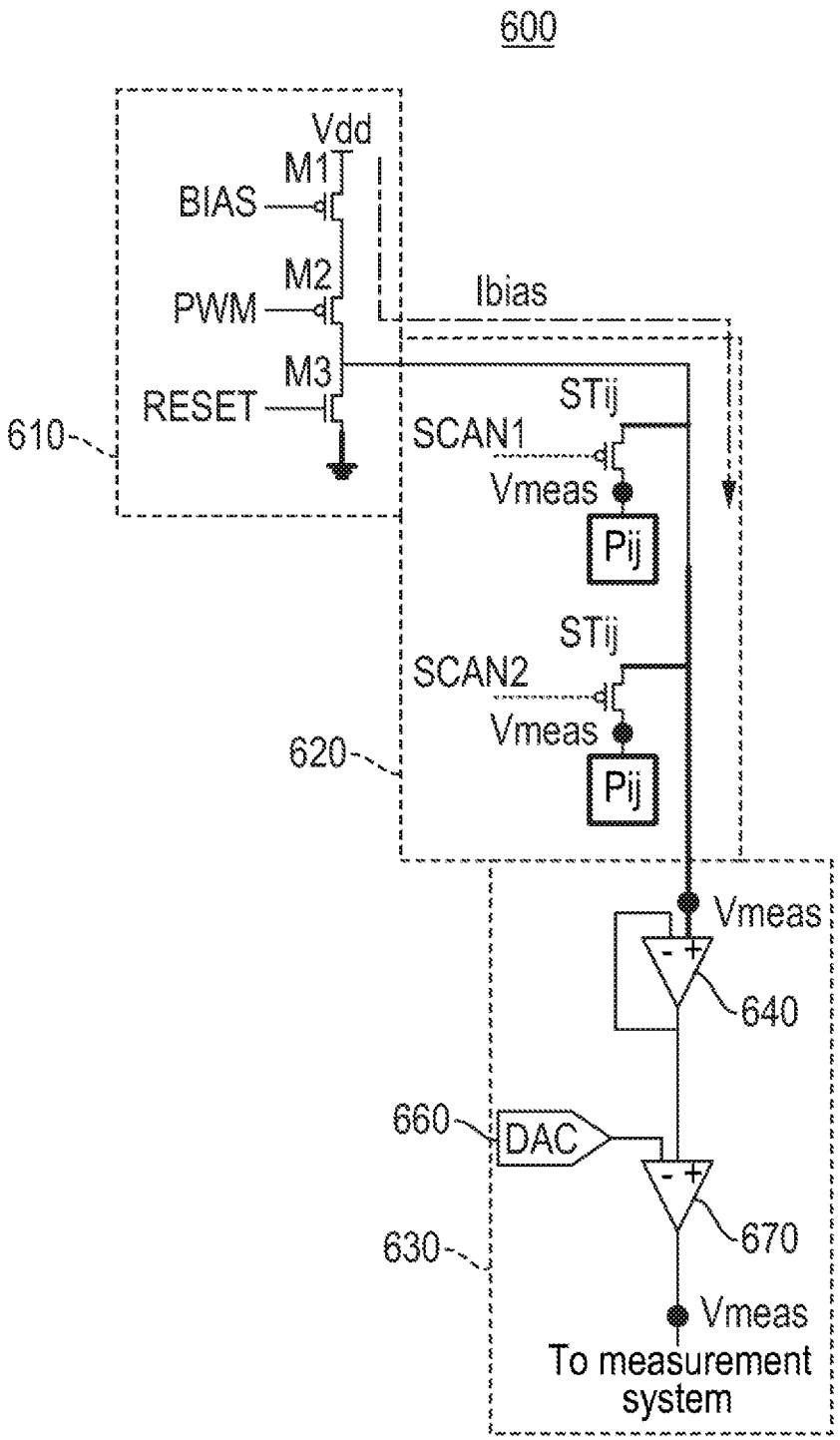
FIGS. 6A and 6B illustrate a fifth approach to the Test Driver Architecture, according to embodiments of the disclosure.
Figure 6B:
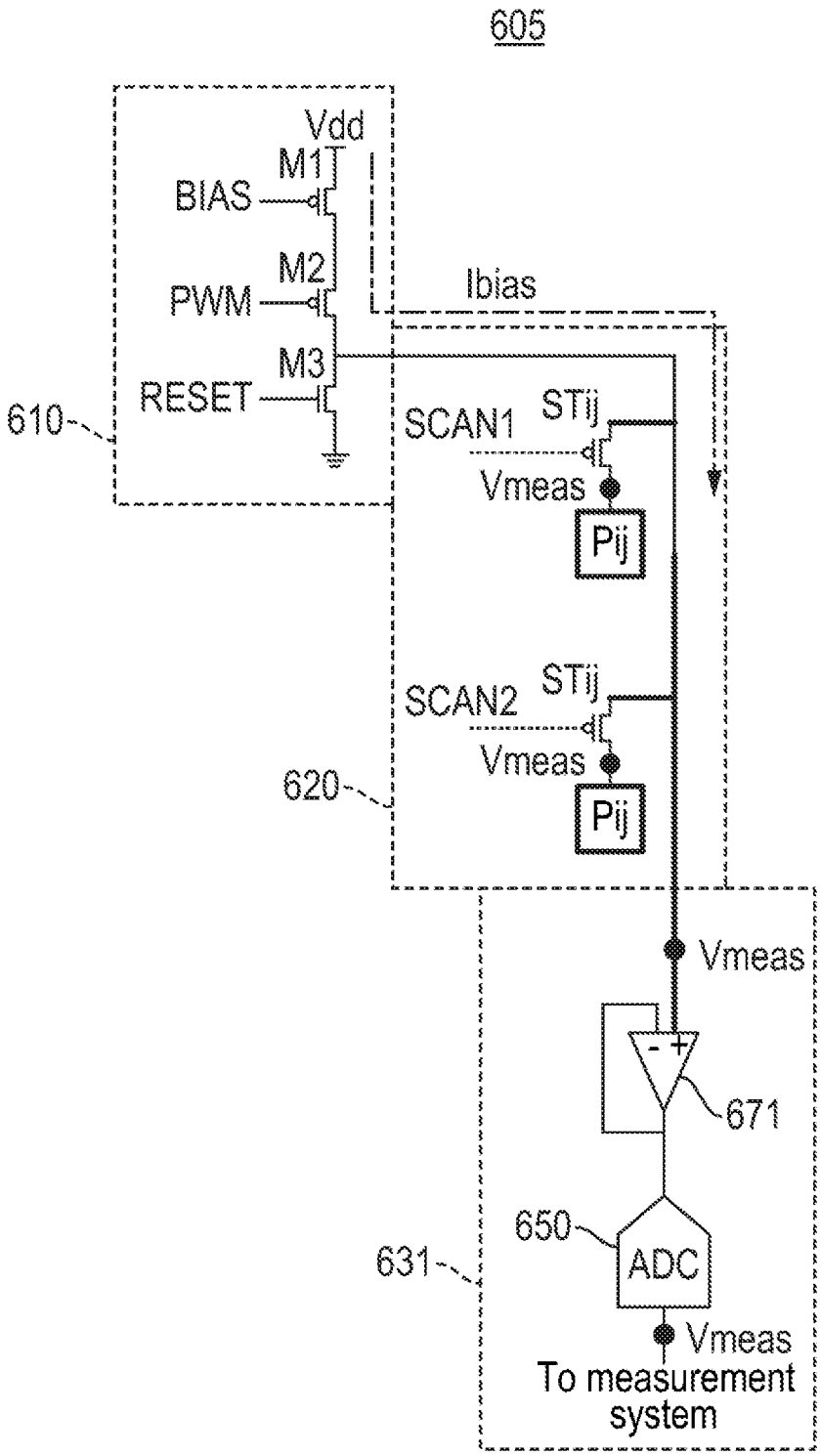

FIGS. 6A and 6B illustrate a fifth approach to the Test Driver Architecture 600, according to an embodiment of the disclosure. The fifth approach does not require modification to either the Active Array 620 or the DDIC 610. Instead, a first measurement circuit 630 or a second measurement circuit 631 is added that is separate from the Active Array 620 and the DDIC 610. For ease of illustration, FIGS. 6A and 6B only show one column being measured. However, more than one column of LEDs may be measured in this manner. Again, one row may be selected at any given time by a SCAN signal.

DAC vs. ADC Measurement Devices

The Test Driver Architectures described above may be implemented in various measurement devices and measurement systems. FIGS. 6A and 6B also illustrate two alternative measurement devices—DAC vs. ADC—for obtaining a digital value representing the measured voltage Vmeas. FIG. 6A shows a Test Driver Architecture 600 that uses a DAC-based measurement circuit 630, and FIG. 6B shows a Test Driver Architecture 605 that uses an ADC-based measurement circuit 631. As shown in FIG. 6A, the DAC-based measurement circuit 630 utilizes a buffer 640, a Digital-to-Analog Converter (DAC) 660, and a comparator 670. In this configuration, the DAC-based measurement circuit 630 senses the voltage Vmeas and compares it with a reference voltage Vref. Vref is digitally controlled and generated using the DAC 660, and it is "ramped" up, as discussed in further detail below with reference to FIG. 12. Vref increases until it is equal to or greater than Vmeas and then the comparator 670 changes its output state. This triggering condition, indicating that the analog values Vref≥Vmeas, causes the measurement system to record the digital value provided to the DAC 660 at the moment that the comparator 670 changes its output state. The digital value thus reflects the voltage measurement Vmeas. A 10-bit DAC 660 may ramp the reference voltage Vref from 0 V to 5 V through $2^{10}$ levels (or 1024 levels) in order to identify the measured voltage Vmeas. The DAC-based measurement circuit 630 may use $2^n$ clock cycles to achieve a resolution of n bits. The measurement system may include a memory device for storing the digitized voltage Vmeas and the bias current Ibias as a data pair, and for storing a plurality of data pairs as an I-V curve. The DAC-based measurement circuit 630 may be adopted in different embodiments of the disclosure, including the first, second, third, fourth, and/or fifth approach described above.

By contrast, the ADC-based measurement circuit 631 shown in FIG. 6B utilizes a buffer 671 and an ADC 650. For example, the ADC-based measurement circuit 631 may perform a binary search for the measured voltage Vmeas using m clock cycles for n bits of resolution or accuracy ($n \le m \le 2n$). The ADC-based measurement circuit 631 may be adopted in different embodiments of the disclosure, including the first, second, third, fourth, and/or fifth approach described above.

Figure 7:
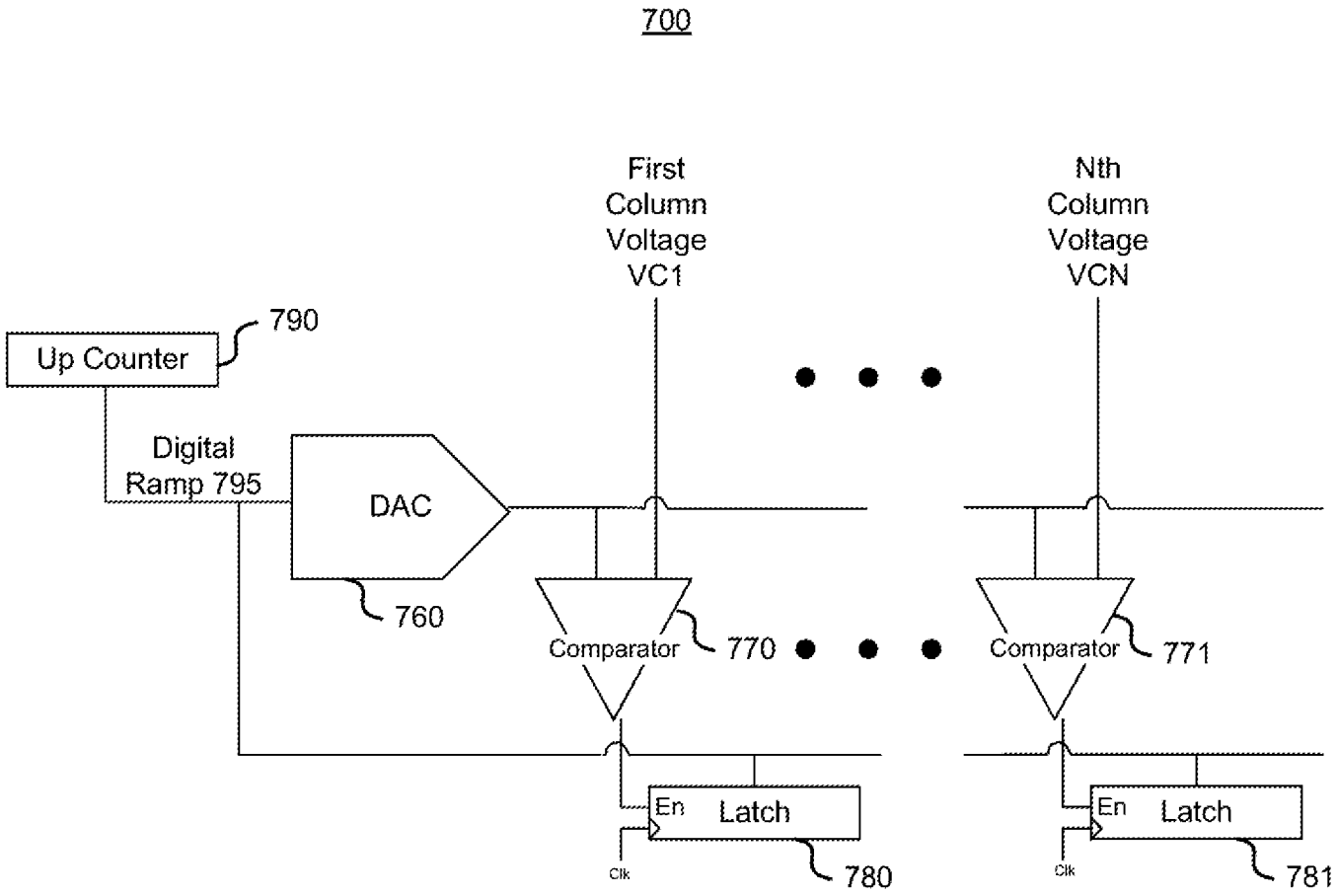
FIG. 7 presents a specific implementation of the DAC-based measurement device, according to an embodiment of the disclosure.

FIG. 7 presents a specific implementation of a DAC-based measurement circuit 700, according to an embodiment of the disclosure. Here, LED voltages VC1 . . . VCN from multiple columns of the Active Array are measured. In this particular example, each column that is measured has a dedicated comparator 770 . . . 771 and latch 780 . . . 781 to latch the output of the comparator 770 . . . 771. However, there is only one DAC 760 and one up-counter 790 that is shared among the multiple columns. This particular design takes advantage of the fact that the digital ramp 795 generated by the up-counter 790, as well as the analog form of the ramp signal that is provided by the DAC 760, can be shared across the multiple columns of LEDs being measured. In this implementation, there is no need to separately generate either the digital ramp signal 795 or the analog ramp signal for different columns. However, before stepping the bias current to the next step/level for I-V curve generation, all comparators must trip or change states before the digital ramp 795 can be reset. In other examples, a separate DAC 760 may be provided for each column or for each of a plurality of groupings of columns.

Multiplexing

Figure 8:
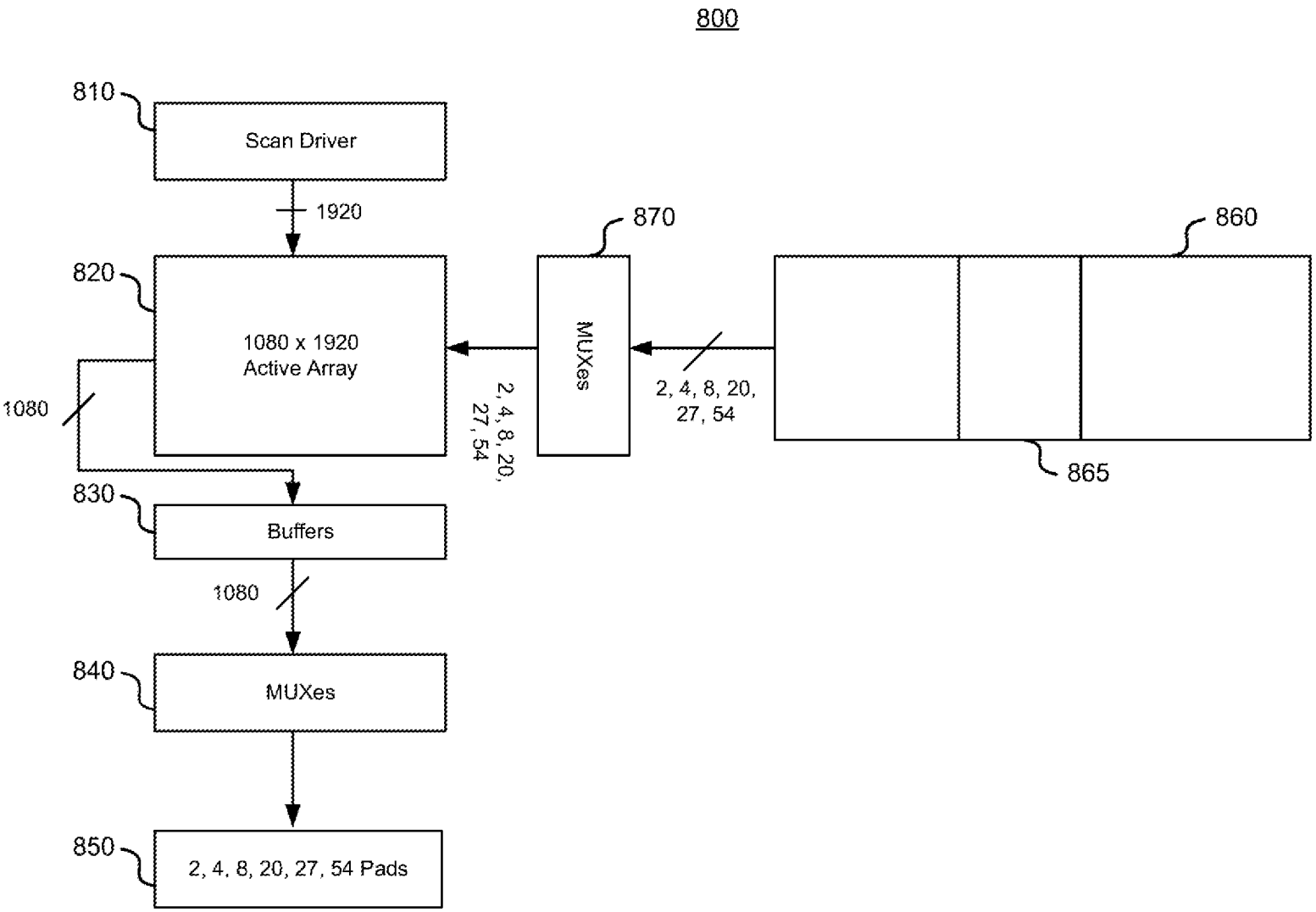
FIG. 8 is a block diagram showing a multiplexing structure for performing measurement on select portions of an Active Array, according to an embodiment of the disclosure.

FIG. 8 is a block diagram showing a multiplexing structure 800 for performing measurement on select portions of an Active Array, according to an embodiment of the disclosure. The multiplexing structure 800 includes a scan driver block 810, a 1080 by 1920 Active Array 820, a bank of buffers 830, a first set of multiplexers 840 following the bank of buffers 830, and a set of pads 850. The multiplexing structure 800 also includes a test driver block 860 that may be a modified Normal Driver Architecture DDIC with 1080 available output having a variable-width output 865 that may be 2, 4, 8, 20, 27, or 54 channels wide, and a second set of multiplexers 870 that are capable of receiving the variable-width output of the test driver block 860.

In this embodiment, the number of LEDs that are driven in parallel at any given time by the test driver block 860 is selectable (e.g., 2, 4, 8, 20, 27, or 54 LEDs at a time). Such a variable-width test driver block 860 may be implemented by modifying a full-width Normal Driver Architecture DDIC. The chosen number of drivers is simply taken from the full-width of the driver. As pictorially shown, a select portion 865 of drivers (e.g., 54 drivers) are taken from the full width of drivers (e.g., 1080 drivers) of the Normal Driver Architecture DDIC.

The first set of multiplexers 840 and the second set of multiplexers 870 allow the limited number of channels (e.g., 54) of the measurement system to be applied to different columns of the Active Array 820. For example, for a particular row of 1080 LEDs to be tested, the first set of multiplexers 840 and the second set of multiplexers 870 can allow the 54-channel measurement system to drive and measure a first set of 54 LEDs in the row. Once those results are obtained, the first set of multiplexers 840 and the second set of multiplexers 870 switch to allow a different set of 54 LEDs in that row to be driven and measured, and so on. By performing such a switching function for 20 different sets of 54 LEDs, then all 1080 LEDs (i.e., 54×20) of the row can be driven and measured. The scan signals provided by the scan driver can be used to then select a different row of the Active Array 820 for testing. All 1920 rows of the Active Array 820 can be tested in a similar manner.

In the embodiment shown in FIG. 8, the second set of multiplexers 870 provides the selected portion (e.g., 54 outputs) from the full width output of the buffer bank 830 to the Active Array 820. In other embodiments, the test driver block 860 may include both the driving function as well as the measuring function. In that case, the test driver block 860 may already have access to the appropriate measurement points (e.g., for 54 voltage measurements), and it may be possible to operate the measurement system using only the first set of multiplexers 840.

Figure 9A:
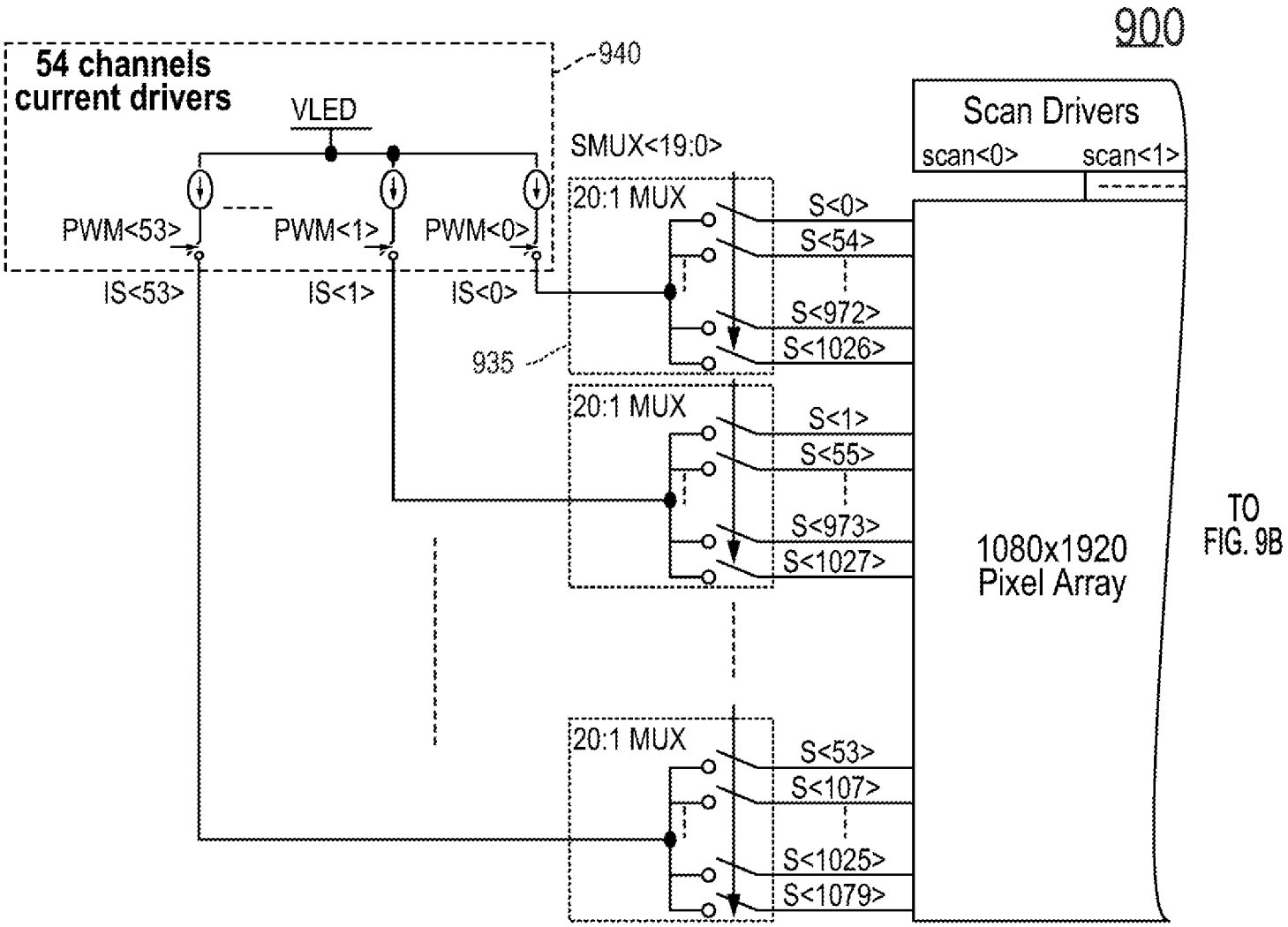
FIGS. 9A and 9B present a circuit diagram of a 54-channel test driver block, according to an embodiment of the disclosure.
Figure 9B:
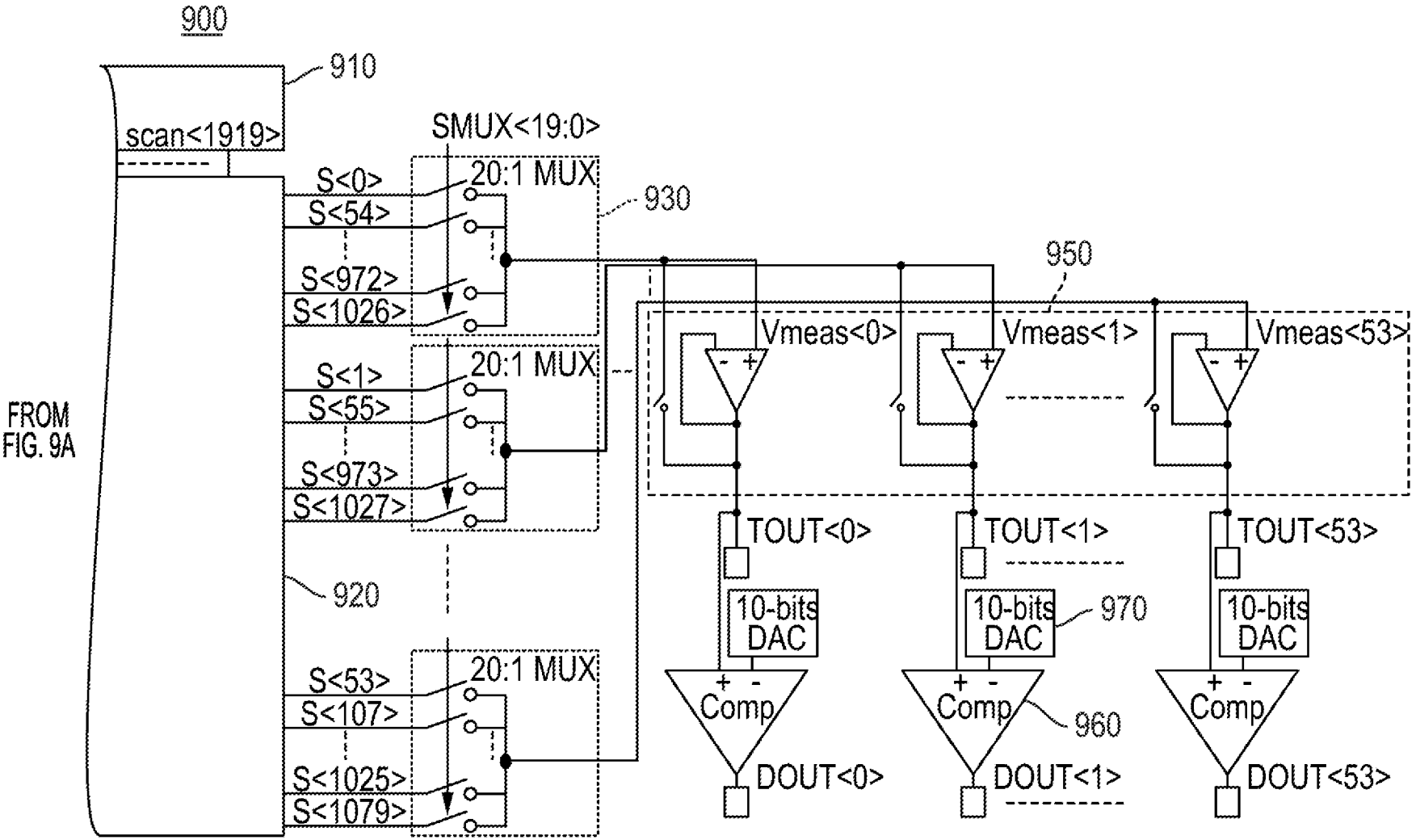

FIGS. 9A and 9B present a circuit diagram of a 54-channel test driver block 900, according to an embodiment of the disclosure. The test driver block 900 includes a set of scan drivers 910, a 1080×1920 Active Array 920 of LEDs, fifty-four 20:1 multiplexers 930, fifty-four 20:1 multiplexers 935, a 54 channel set of current drivers 940, 54 buffers 950 that are capable of low input loading and high output drive, 54 comparators 960, and 54 10-bit DACs 970. The multiplexers 935 and 930 provide flexibility at the input and the output of the Active Array 920. The scan drivers 910 select a particular row to be tested, out of the 1920 rows of the Active Array 920. The 54 channel set of current drivers 940 includes 54 individual current sources that provide a known current output. In this example, each of the 54 current outputs is modulated using pulse width modulation and provided to a 20:1 multiplexer 930, which connects the current output to an selected column (out of 1080 columns) in the Active Array 920. The combination of the row selection by the scan drivers 910 and the column selection by the 1:20 multiplexer 930 isolates the particular 54 LEDs to be tested in parallel. Each of the 10-bit DACs 970 in this configuration performs a binary search sweep rather than a linear sweep of the reference voltage to the respective comparator 960, to achieve the DAC-based voltage measurement for the 54 selected LEDs. This greatly speeds up the measurements and reduces test/measurement time. The test driver block 900 is programmable at the input and the output of the Active Array 920.

SPI-based Measurement System—DAC

Figure 10:
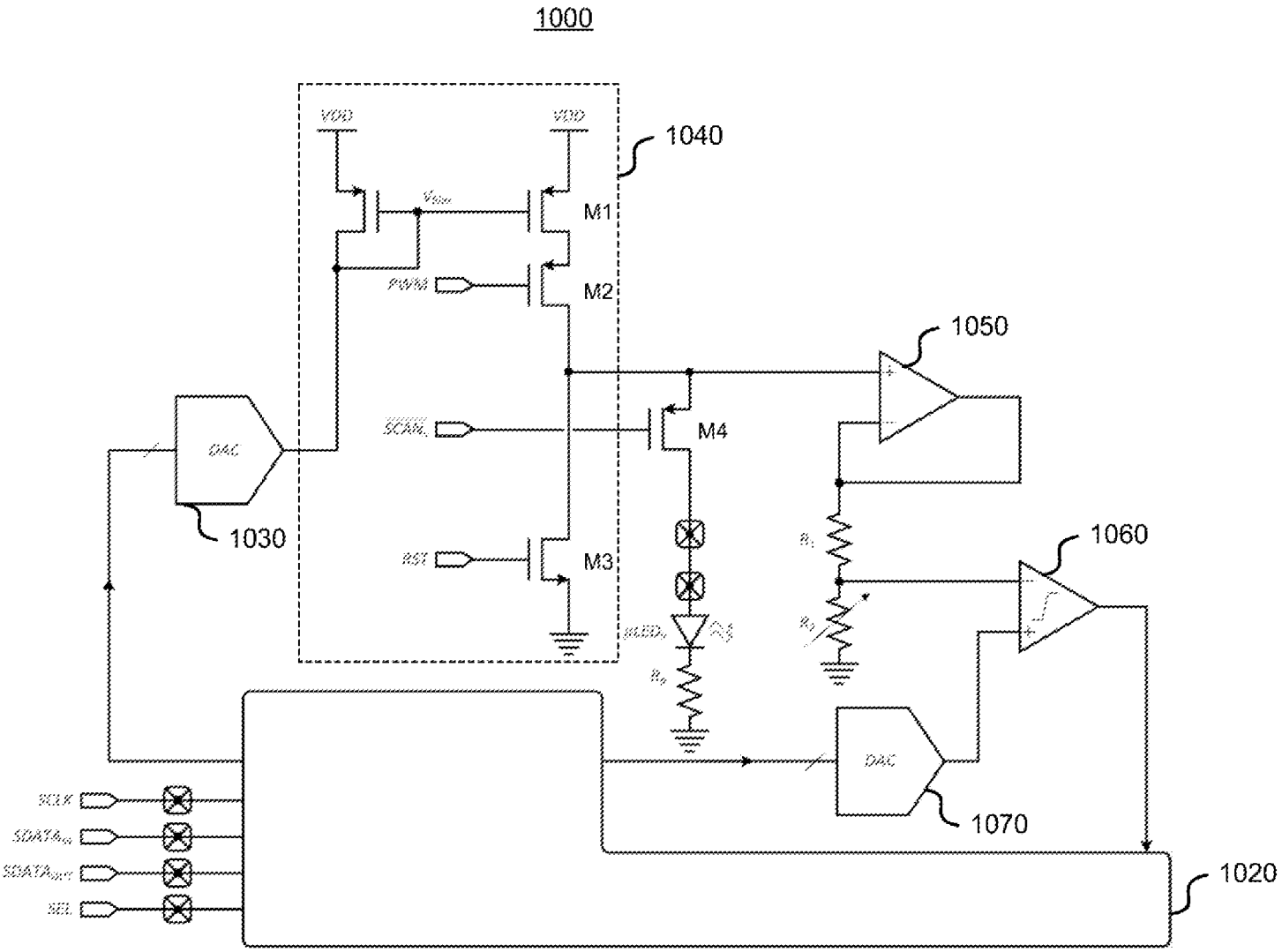
FIG. 10 is a simplified diagram showing the use of a serial peripheral interface (SPI)-based measurement system for performing DAC-based measurements for one LED, according to an embodiment of the disclosure.

FIG. 10 is a simplified diagram showing use of a serial peripheral interface (SPI)-based measurement system 1000 for performing DAC-based measurements for one LED, according to an embodiment of the disclosure. While only one LED μLEDij is shown for illustration purposes, measurement of multiple LEDs is typically implemented. The SPI-based measurement system 1000 has electronics 1020 including an SPI controller, digital state machine(s), and storage registers. The electronics 1020 may serve as the measurement system discussed above. The SPI-based measurement system 1000 also includes a first DAC 1030 for controlling the driving current, a DDIC 1040 including transistors M1, M2, and M3, a scan control transistor M4, an LED μLEDij, a buffer 1050 for obtaining the voltage measurement, and a comparator 1060 that compares the voltage measurement to a ramp reference signal provided by a second DAC 1070. Operations of the drive circuit, PWM, row selection using the SCAN signal, buffering of the voltage to be measured, and DAC-based voltage measurement are similar to those described previously. The SPI-based measurement system 1000 controls the first DAC 1030 and the second DAC 1070 to both drive the μLEDij with a known current and to obtain a resulting voltage measurement, using the DAC-based technique. To do so, the SPI-based measurement system 1000 utilizes signals such as the SCLK, SDATAin, $SDATA_{out}$, and SEL signals. The SCLK signal provides a system clock upon which the operation of the serial peripheral interface is based. The $SDATA_{in}$ signal allows values to be imported such as the programmed digital values for controlling the first DAC 1030 and the second DAC 1070. The SDATAout signal allows values to be outputted such as the output of the comparator 1050. The state machine(s) and storage registers may be used to implement logic for controlling various levels of drive currents and iterations, such as those involving counters, needed in driving the DAC-based measurements, and storage of programmed values and measurements results.

Figure 11:
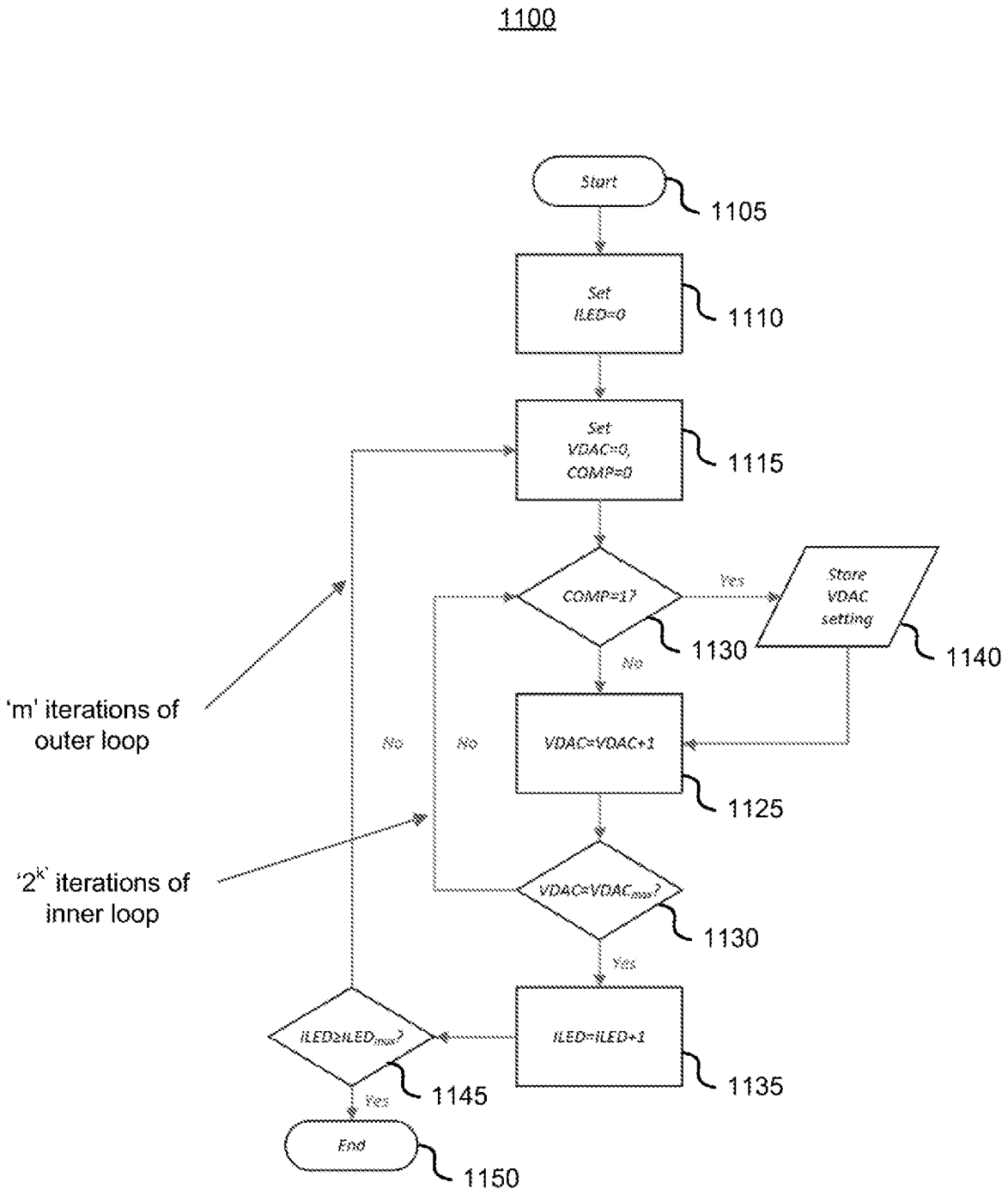
FIG. 11 is a flow chart showing illustrative steps in a process for driving multiple levels of known currents and obtaining DAC-based voltage measurements for one LED, according to an embodiment of the disclosure.

FIG. 11 is a flow chart showing illustrative steps in a process 1100 for driving multiple levels of known currents and obtaining DAC-based voltage measurements for one LED, according to an embodiment of the disclosure. There are two main loops shown, an outer loop and an inner loop. The outer loop has m iterations. For each iteration of the outer loop, a particular known current level is set for the plurality of current drivers. The inner loop has $2^K$ iterations. For each iteration of the inner loop, a particular digital value is provided to the DAC to effectuate a different reference voltage provided to the comparator. The process 1100 starts at block 1105. The ILED index value is initiated to 0 at block 1110. Here, the ILED index value is expressed as an integer index, e.g., 0, 1, 2, 3, etc. Each ILED index value is associated with a particular magnitude of drive current. In each iteration of the outer loop, the inner loop is operated by initiating the VDAC index value and COMP state value to 0 at block 1115. Within the inner loop, the process 1100 operates by first determining whether the COMP state value is equal to 1 at block 1120. If not, the VDAC index value is incremented by 1 at block 1125, which operates to step up the DAC-based voltage measurement to the next reference voltage level in the voltage ramp. Then, it is determined whether the VDAC index value has reached its maximum at block 1130, which indicates the DAC has climbed the entire voltage ramp. If not, then the process 1100 loops back to the step of determining whether the COMP state is equal to 1 at block 1120. If the COMP state is equal to 1, indicating the voltage being measured has crossed the voltage reference provided by the DAC, the VDAC setting is stored at block 1140. In this manner, the inner loop iterates over the $2^K$ possible levels of the reference voltage ramp, and the outer loop iterates over the m possible driving current levels, to provide m pairs of current vs. voltage (IV) values. If the VDAC index value has reached its maximum at block 1130, the ILED index value is incremented by 1 at block 1135. It is then determined whether the ILED index value has reached its maximum at block 1145. If not, the process 1100 loops back to block 1115. If so, the process 1100 ends at block 1150.

Figure 12:
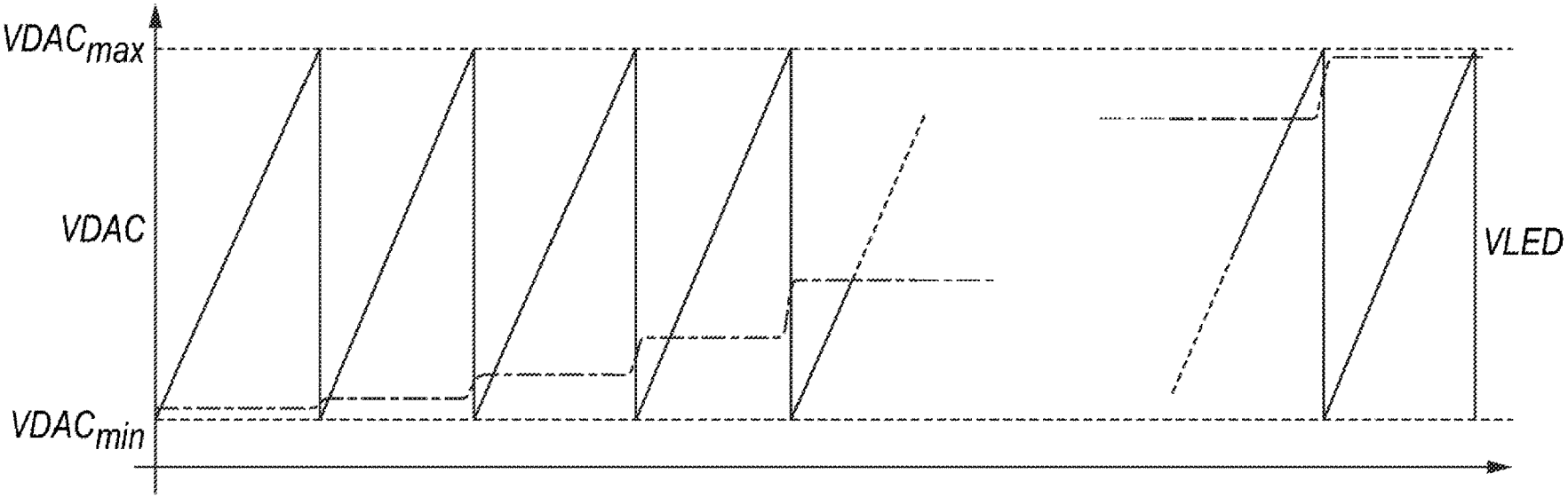
FIG. 12 illustrates a full sweep of the LED bias current and the resulting LED voltage waveform/level for a single LED measured by a DAC-based measurement system, according to an embodiment of the disclosure.

FIG. 12 illustrates a full sweep of the LED bias current and resulting LED voltage waveforms 1200 for one LED measured by a DAC-based measurement system, according to an embodiment of the disclosure. These signals may be used by the DAC-based measurement circuit 630 shown in FIG. 6 to obtain the measured voltage Vmeas. Here, the VDAC signal represents the analog reference voltage that is output by the DAC 660 and provided as an first input to the comparator 670. The VLED signal represents the voltage of the LED being measured. The VLED signal may be buffered, as previously discussed. As shown, the LED may be driven by different current levels in the measurement process. For example, the LED may be driven at m different bias currents Ibias each of which corresponds to one of the steps (e.g., m steps) shown in the VLED signal. For each bias current Ibias, the DAC-based measurement technique generates an analog reference voltage VDAC. The VLED and VDAC signals are provided as inputs to the comparator. The analog reference voltage VDAC is ramped until the output of the comparator indicates that the VLED and VDAC signals have crossed each other. At the cross-over point, the digital input value of the DAC, which generates the VDAC signal, reflects the voltage magnitude of the VLED signal. This voltage is recorded as the measured voltage Vmeas for the corresponding bias current Ibias. The bias current Ibias is then increased to the next step, and the above process is repeated to obtain the measured voltage Vmeas that corresponds to the new bias current Ibias. In this way the I-V curve is obtained for the LED being measured.

Figure 13:
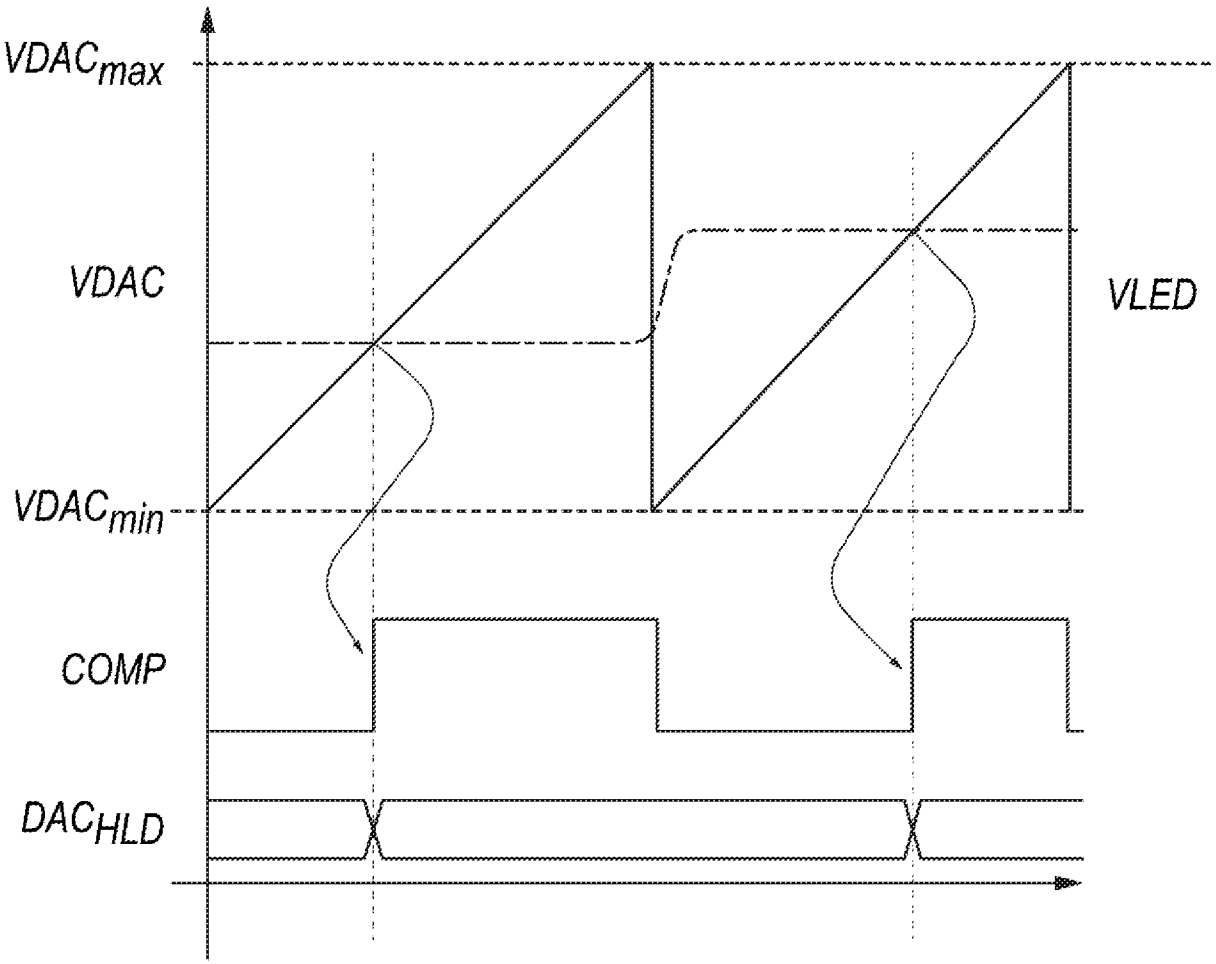
FIG. 13 illustrates a first plot showing a zoomed-in version of the LED voltage versus bias current waveform/sweep shown in FIG. 12, a second plot showing a comparator output waveform showing tripping/switching, and a third plot showing bias current DAC trip point storage/recording to illustrate operation of the DAC-based measurement system.

FIG. 13 includes a top plot showing a zoomed-in version of the LED voltage versus bias current waveform/sweep shown in FIG. 12, a middle plot showing a comparator output waveform showing tripping/switching, and a bottom plot showing bias current DAC trip point storage/recording to illustrate operation of the DAC-based measurement system. In the middle plot, the COMP signal indicates the output of the comparator. When the COMP signal transitions from "0" to "1," indicating that the magnitude of the VDAC signal has become greater than that of the VLED signal, this marks the cross-over point discussed above. At the cross-over point, a DACHLD signal is asserted as shown in the bottom plot to hold or store the digital input value of the DAC, in order to capture the value as a representation of the voltage magnitude of the VLED signal.

Figure 14:
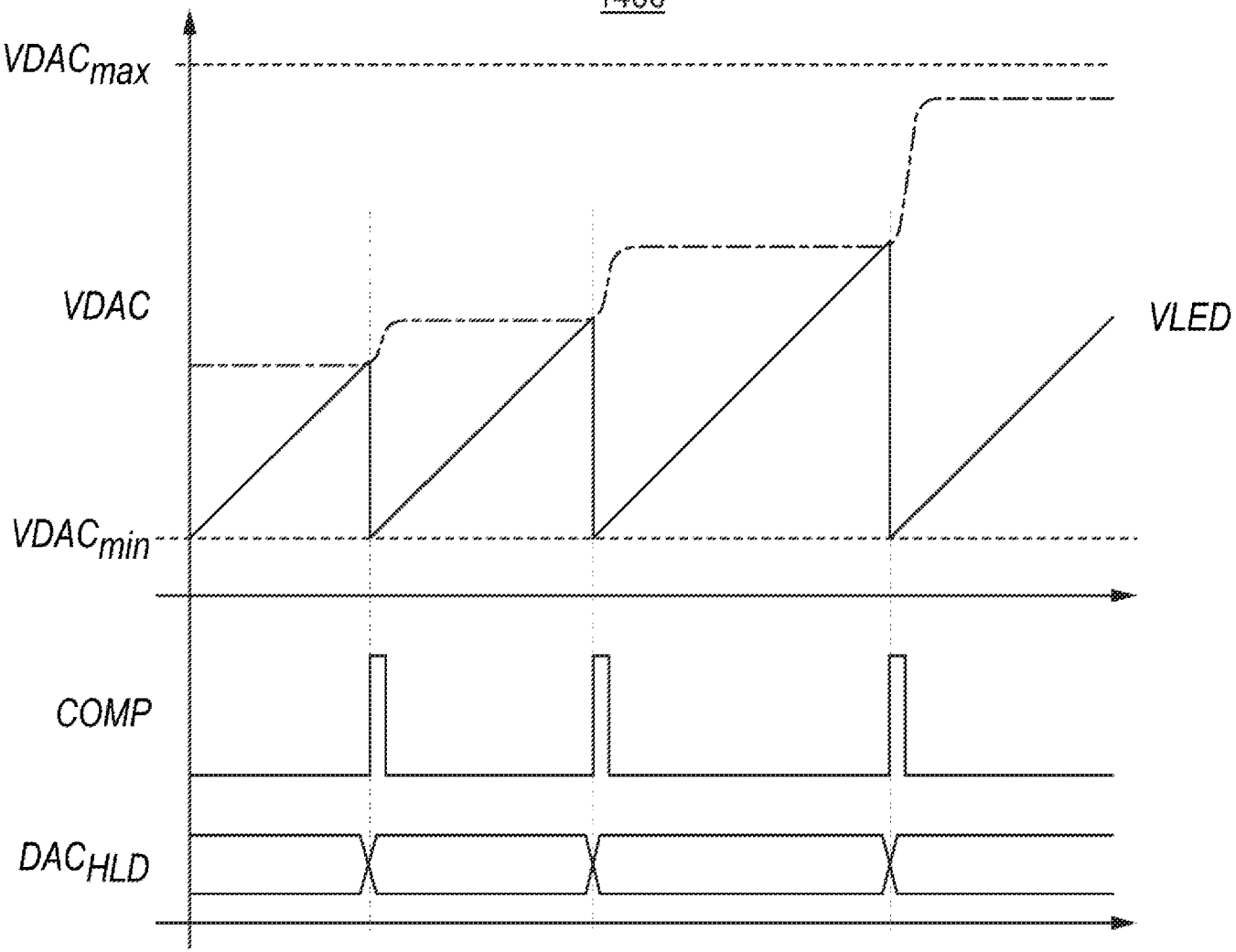
FIG. 14 illustrates a modified bias current sweep scheme for a DAC-based LED I-V/LI-V measurement system according to an embodiment of the disclosure.

FIG. 14 illustrates a modified bias current sweep scheme for a DAC-based LED I-V/LI-V measurement system according to an embodiment of the disclosure. Here, the VDAC signal is not allowed to ramp up to its maximum value in each measurement. Instead, as soon as the cross-over point is detected, a reset signal is used to reset the VDAC signal, to restart the next ramp up cycle immediately. As shown in FIG. 14, each time the VDAC signal crosses over the VLED signal, the COMP signal transitions from "0" to "1." Immediately, the VDAC signal is reset to start the next ramp up and is not allowed to operate through its full sweep until it reaches its VDAC maximum value. This approach has the benefit of shortening the overall measurement time. However, the measurement duration can become less predictable, because it would vary depending on the voltage being measured.

Figure 15:
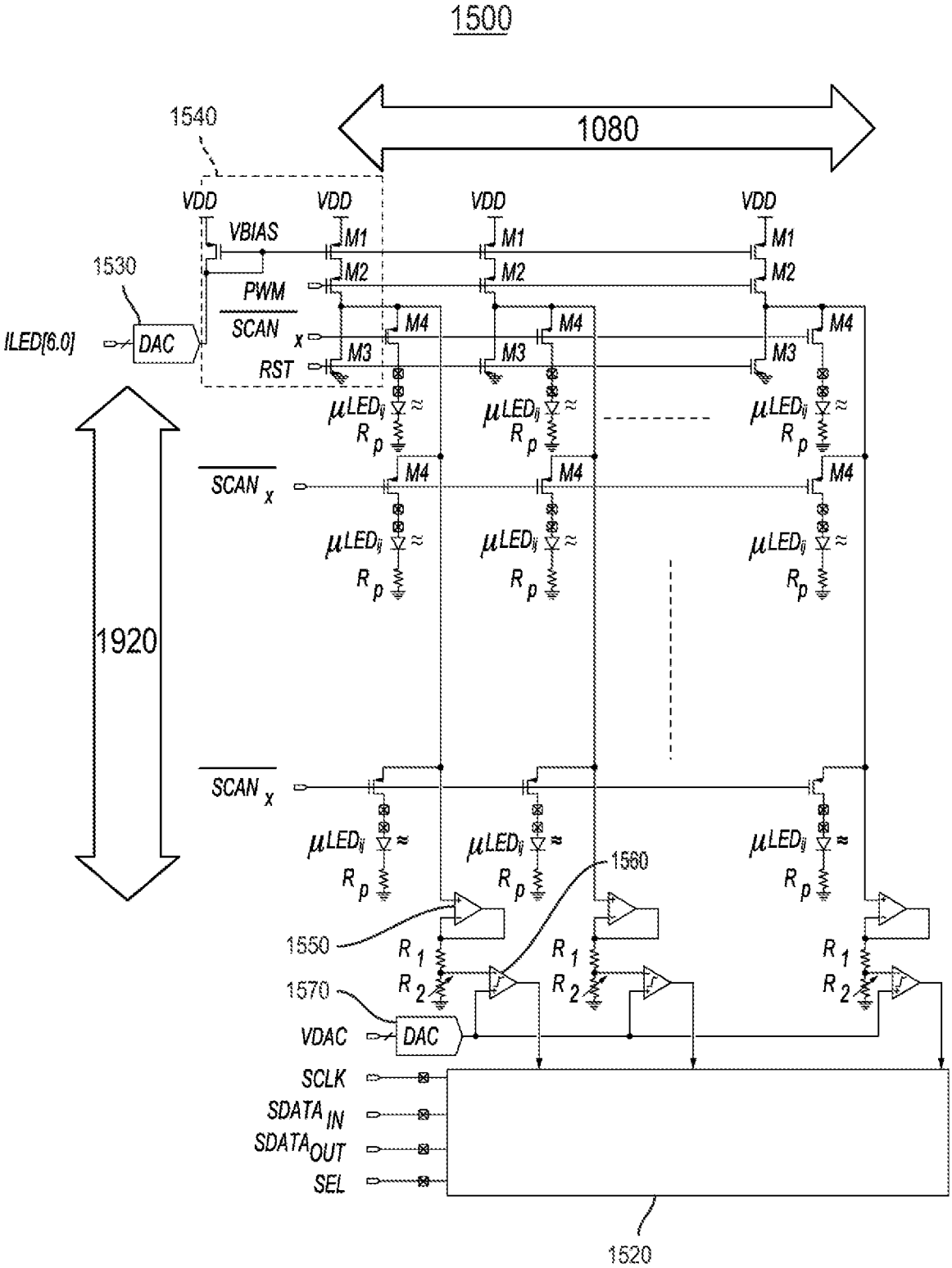
FIG. 15 is a more detailed diagram showing use of a serial peripheral interface (SPI)-based measurement system for performing DAC-based measurements for multiple LEDs, according to an embodiment of the disclosure.

FIG. 15 is a more detailed diagram showing the use of a serial peripheral interface (SPI)-based measurement system 1500 for performing DAC-based measurements for multiple LEDs, according to an embodiment of the disclosure. As an example, measurement for an Active Array having 1080 columns and 1920 rows of LEDs is shown. The SPI-based measurement system 1500 has electronics 1520 including an SPI controller, digital state machine(s), and storage registers. The SPI-based measurement system 1500 also includes a first DAC 1530 for controlling the driving current, a plurality of DDICs 1540 including transistors M1, M2, and M3, a plurality of scan control transistors M4, a plurality of LEDs μLEDij, a plurality of buffers 1550 for obtaining the voltage measurements, and a plurality of comparators 1060 that compare the voltage measurements to a ramp reference signal provided by a second DAC 1070. The SPI-based measurement system 1500 operates in a similar manner to the SPI-based measurement system 1000 shown in FIG. 10, but for multiple LEDs at any given time.

SPI-based Measurement System—ADC

Figure 16:
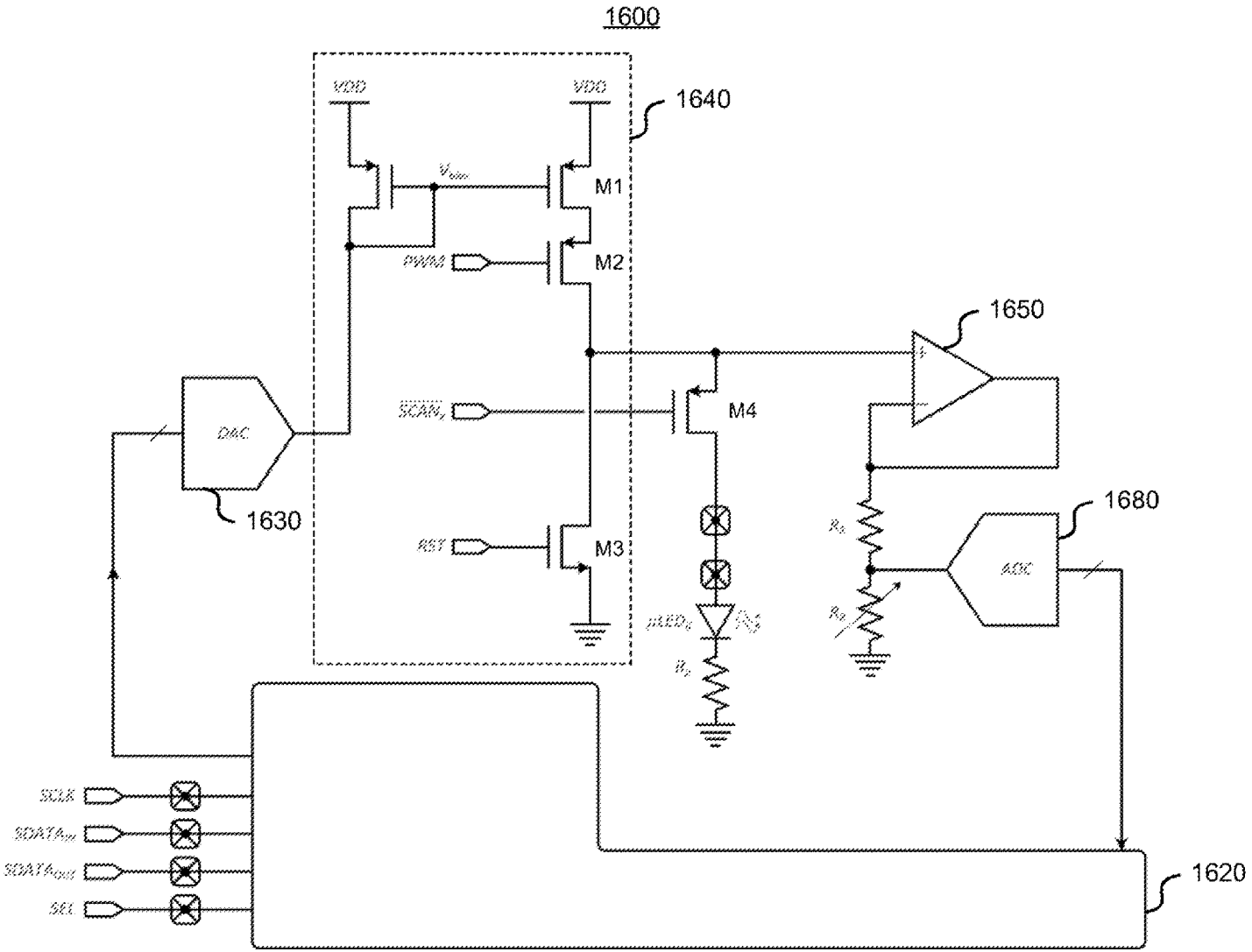
FIG. 16 is a simplified diagram showing use of a serial peripheral interface (SPI)-based measurement system for performing ADC-based LED I-V and/or LI-V measurements for one LED, according to an embodiment of the disclosure.

FIG. 16 is a simplified diagram showing the use of a serial peripheral interface (SPI)-based measurement system for performing ADC-based I-V and/or LI-V measurements for one LED, according to an embodiment of the disclosure. While only one LED μLEDij is shown for illustration purposes, measurement of multiple LEDs is typically implemented. The SPI-based measurement system 1600 has electronics 1620 including an SPI controller, digital state machine(s), and storage registers. The SPI-based measurement system 1600 also includes a DAC 1630 for controlling the driving current, a DDIC 1640 including transistors M1, M2, and M3, a scan control transistor M4, an LED μLEDij, a buffer 1650 for obtaining the voltage measurement, and an ADC 1680. Operations of the drive circuit, PWM, row selection using the SCAN signal, buffering of the voltage to be measured, and ADC-based voltage measurement are similar to that described previously. The SPI-based measurement system 1600 controls the DAC 1630 to drive the LED μLEDij with a known current and obtains a resulting voltage measurement, using the ADC-based technique. To do so, the SPI-based measurement system 1600 utilizes signals such as the SCLK, $SDATA_{in}$, $SDATA_{out}$, and SEL signals. The SCLK signal provides a system clock upon which the operation of the serial peripheral interface is based. The $SDATA_{in}$ signal allows values to be imported such as the programmed digital values for controlling the DAC 1630. The SDATAout signal allows values to be outputted such as the digital output of the ADC 1680. The digital state machine(s) and storage registers may be used to implement logic and storage for such operations.

Figure 17:
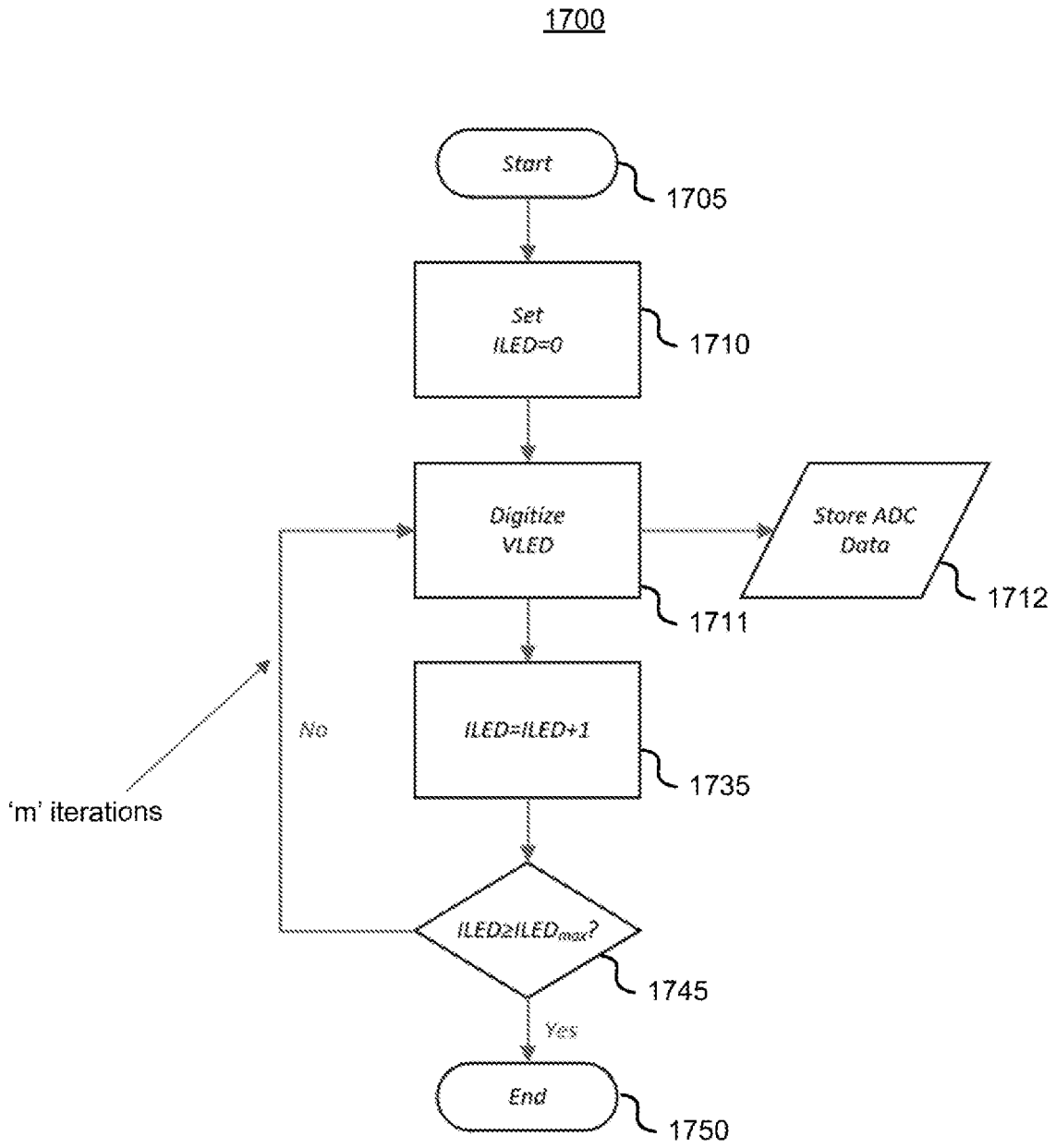
FIG. 17 is a flow chart showing illustrative steps in a process for driving multiple levels of known currents and obtaining ADC-based voltage measurements, according to an embodiment of the disclosure.

FIG. 17 is a flow chart showing illustrative steps in a process 1700 for driving multiple levels of known currents and obtaining ADC-based voltage measurements, according to an embodiment of the disclosure. The process 1700 includes a loop having m iterations. For each iteration, a particular known current level is set for the plurality of current drivers. The process 1700 starts at block 1705. The ILED index value is initiated to 0 at block 1710. Here, the ILED index value is expressed as an integer index, e.g., 0, 1, 2, 3, etc. Each ILED index value is associated with a particular magnitude of drive current. In each iteration of the loop, the measured voltage of the LED, VLED, is digitized by the ADC at block 1711. In addition, the ADC data, i.e., a digital measured voltage value for each driving current magnitude, is stored at block 1712. The ILED index is incremented by 1 at block 1735. Finally, the ILED index value is compared to its maximum value at block 1745, to determine whether testing at all the driving current levels have been completed. If not, the loop iterates again by returning to block 1711. If so, the process 1700 ends at block 1750. In this manner, the loop iterates over the m possible driving current levels, to provide m pairs of current vs. voltage (IV) values.

Figure 18:
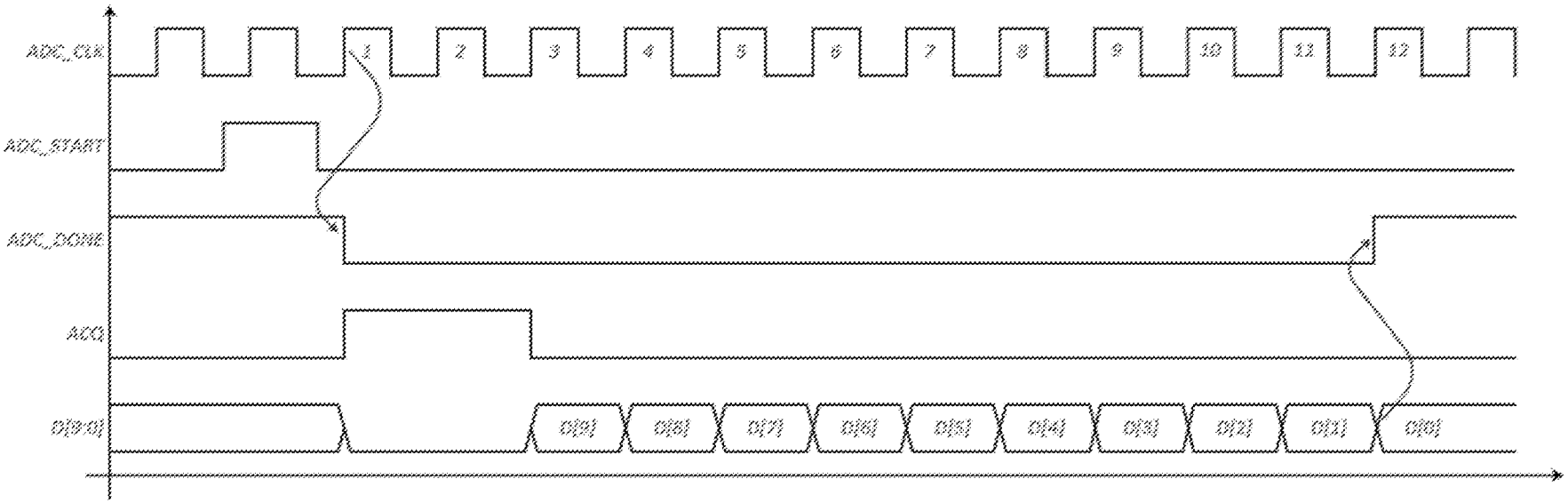
FIG. 18 presents illustrative signals associated with an ADC conversion cycle for a single voltage measurement for one LED, according to an embodiment of the disclosure.

FIG. 18 presents illustrative signals 1800 associated with an ADC conversion cycle for a single voltage measurement for one LED, according to an embodiment of the disclosure. These signals may be used by the ADC-based measurement circuit 631 shown in FIG. 6 to obtain the measured voltage Vmeas. In the example shown in FIG. 18, a 10-bit ADC operates on a clock signal ADC CLK. Also shown are signals ADC START and ADC DONE, which indicate the beginning and completion, respectively, of the ADC conversion cycle. Also, an ACQ signal indicates when the ADC is in acquisition mode during which time it acquires or samples the input voltage. Data lines D[9:0] indicate the sequential output of each bit of the ADC output. As shown, for k bits, the ADC may take k+2 clock cycles to complete a single conversion. In the case of the 10-bit ADC shown, the conversion cycle may take 10+2=12 clock cycles to complete. Once the start trigger occurs, the acquisition window opens, and the ADC circuit samples the analog voltage and performs a binary search on the voltage. One bit of the voltage is resolved in each cycle, and the search is performed recursively until all of the cycles have been completed.

Figure 19:
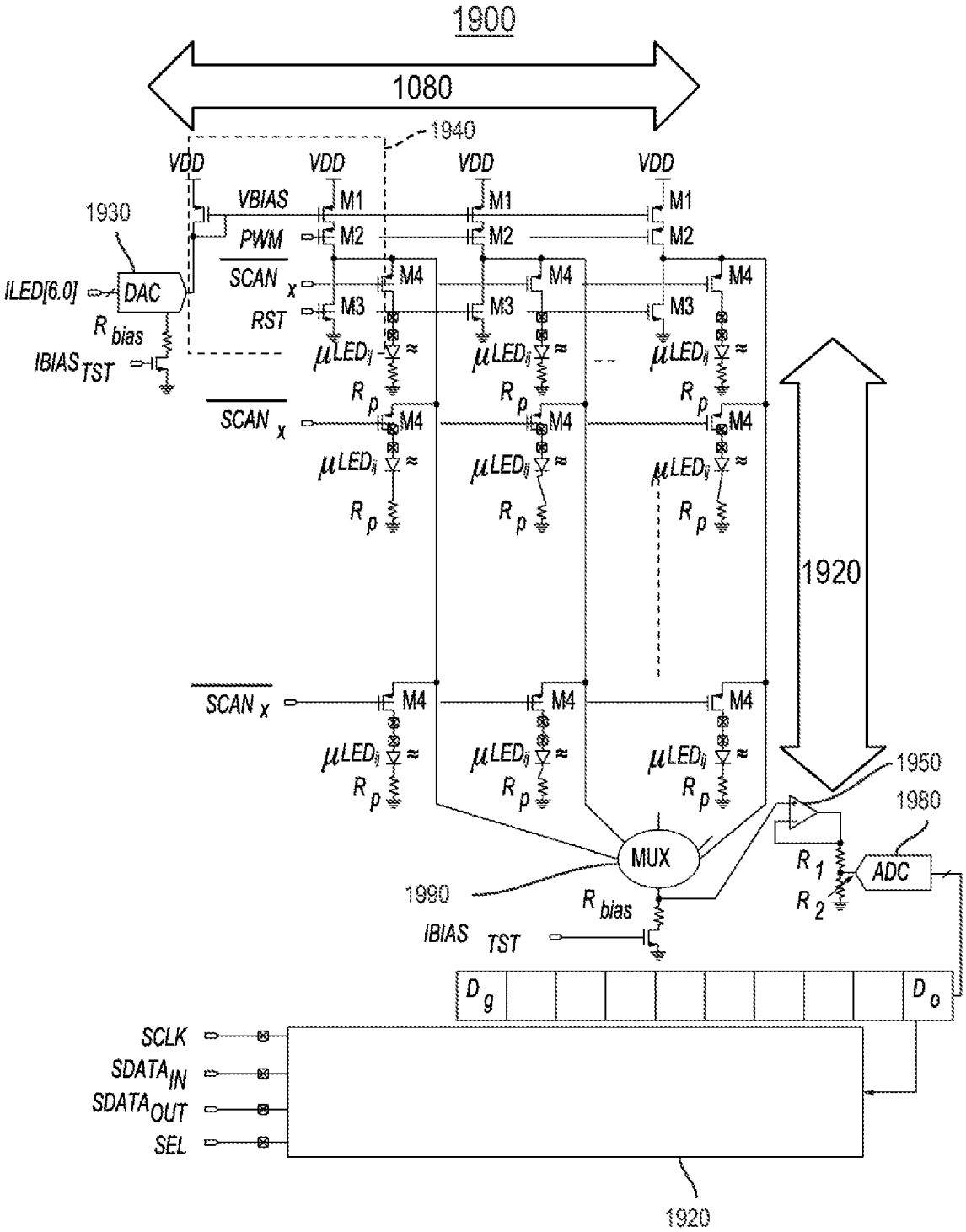
FIG. 19 is a more detailed diagram showing the use of a serial peripheral interface (SPI)-based measurement system for performing ADC-based measurements for multiple LEDs, according to an embodiment of the disclosure.

FIG. 19 is a more detailed diagram showing the use of a serial peripheral interface (SPI)-based measurement system 1900 for performing ADC-based measurements for multiple LEDs, according to an embodiment of the disclosure. As an example, measurement for an Active Array having 1080 columns and 1920 rows of LEDs is shown. The SPI-based measurement system 1900 has electronics 1920 including an SPI controller, digital state machine(s), and storage registers. The SPI-based measurement system 1900 also includes a DAC 1930 for controlling the driving current, a plurality of DDICs 1940 including transistors M1, M2, and M3, scan control transistors M4, LEDs μLEDij, a buffer 1950 for obtaining the voltage measurement, an ADC 1980, and a multiplexer 1990 for selecting one particular voltage output to be measured. For example, a k-bit ADC, with k=10, would generate a 10-bit digital value for each voltage measurement. Thus, the ADC-based voltage measurement is performed in a manner similar to that described with respect to FIG. 16, but for multiple LEDs.

The number of clock cycles required to obtain the desired measurements for the IV curve may differ for the ADC-based measurement approach illustrated in FIG. 19, as compared to the DAC-based measurement approach illustrated in FIG. 15. In the ADC-based measurement approach shown in FIG. 19, each ADC measurement may take (k+2) cycles to complete. The n columns of LEDs may be measured sequentially. Thus, the number of clock cycles required to digitize the n columns of LEDs in sequence over m drive current levels, with a k-bit ADC, may equal to # Cycles=m*n*(k+2). By contrast, in the DAC-based measurement approach shown in FIG. 15, each DAC measurement may require up to $2^k$ clock cycles to complete. However, n columns of LEDs may be measured in parallel. Thus, the number of clock cycles required to digitize the n columns of LEDs in parallel over m drive current levels, with a k-bit DAC, may equal to # Cycles=m*$2^k$.

In the ADC-based measurement approach shown in FIG. 19, each of the 1080 columns terminates into a single multiplexer 1990, which feeds into a single ADC 1980. The ADC 1980 can sample each of the LEDs individually. For example, a SCAN signal may turn on a row of LEDs, and the ADC 1980 may step through each LED within the row and digitize each voltage measurement. Because the ADC 1980 can obtain a voltage measurement in approximately 1-2 μs, the SPI-based measurement system 1900 can measure the voltage of each LED within the entire array in less than 10 seconds.

Modes of Operation

The measurement systems discussed above may include various modes of operation. For example, the measurement systems may include a standby mode, a calibration mode, a uniformity mode, a fully automatic mode, and/or an external trigger mode.

The standby mode may be used as a safe mode to power-up the measurement system. The SPI port and the digital interface may be tested without enabling any analog functions, such as the current drivers. For example, the read/write capability of the SPI port may be verified, the at-speed operation of the SPI port may be verified, the register/bit mapping may be verified, the row/column decoding may be verified, and/or the internal power sequencing may be verified.

The calibration mode may be used to apply a known voltage to each measurement circuit within the measurement system and to digitize the voltage for a three-point calibration. This is because parallel voltage measurements can have a path-to-path mismatch that reduces the accuracy of the measurements. For example, in the Test Driver Architecture 300 shown in FIG. 3, differences in the measurement circuits 330 and 331 may introduce differences in the measured voltage Vmeas of the first LED P11 and the third LED P12. Therefore, in the calibration mode, a known voltage may be applied to the measurement circuits 330 and 331, and any mismatch in the measured voltages may be stored in a register and later removed from measurements of the voltage Vmeas. In some examples, a three-point calibration procedure may be used, in which three voltages are measured and the offset/gain error is calculated by using the three-point measurement. The three voltages may be different fractions of the full-scale voltage. The calibration procedure may be performed for each of the paths within the measurement system. The calibration procedure may be performed before making any I-V or LI-V measurements.

The uniformity mode may be used to measure the uniformity of various LEDs within an array. For example, if a bias current Ibias of 2 mA is applied to each LED, there may be slight differences in the brightness from each LED due to differences in their conversion efficiencies. To assess these differences, the same bias current Ibias may be applied to each LED in sequence, and the brightness or luminance of each LED may be measured. In other examples, the uniformity of a single LED or a subset of the LEDs within an array may be measured. The uniformity mode may be performed after the fully automatic mode in order to investigate areas of the array that are identified as problematic by the fully automatic mode.

The fully automatic mode may be used to automatically measure the I-V curves of each LED between a start address and a stop address. The I-V curves of each LED within an array or a subset of the LEDs within an array may be measured. The I-V curves may be measured by any of the measurement systems discussed above.

The external trigger mode may be used to measure the LI-V curves of each LED between a start address and a stop address. The LI-V curves of each LED within an array or a subset of the LEDs within an array may be measured. An external light sensor, such as a luminance meter, may be used to measure the luminance from the LEDs. A controller associated with the external light sensor may send a trigger signal to activate an LED or a plurality of LEDs after the external light sensor has been aligned to receive light from the LED or the plurality of LEDs. The voltage Vmeas of the LED or each of the plurality of LEDs may be measured sequentially as a function of the bias current Ibias as described above, and the luminance of the LED or each of the plurality of LEDs may be measured simultaneously by the external light sensor. The external light sensor may then be moved to the next area of the array by a mechanical stepper that is operated by the controller. The controller may transmit the measured luminance values to the memory for storage.

Figure 20:
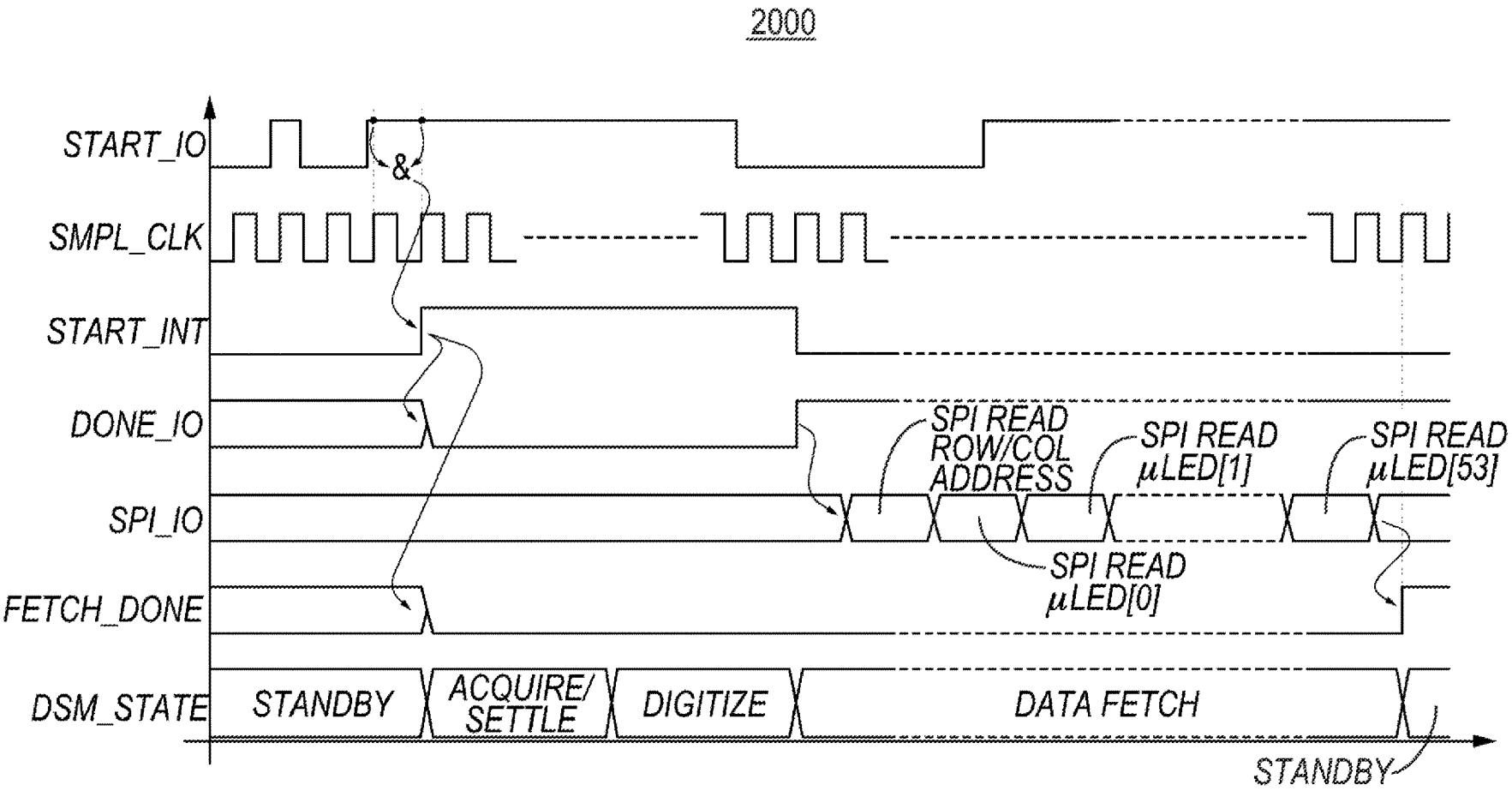
FIG. 20 illustrates timing waveforms for making I-V and/or LI-V measurements on a batch of 54 LEDs, according to an embodiment of the disclosure.

FIG. 20 illustrates timing waveforms 2000 for making I-V and/or LI-V measurements on a batch of 54 LEDs, according to an embodiment of the disclosure. These timing waveforms show 54 parallel measurements and an SPI data fetch. The row labeled "START_IO" is a trigger that is monitored by the measurement system. After the start and stop addresses are set through the SPI, the chip is monitoring the START_IO. As shown in FIG. 20, the first pulse of the START_IO does not trigger anything, but once the START_IO remains high for a length of time as indicated by the second pulse, the START_INT signal is asserted, which causes the digitization sequence to start. Sometime later, the input signals are acquired and then digitized in parallel. Note that this digitization may be performed using either the DAC-based or ADC-based measurement systems outlined earlier. Once the 54 digitizations are complete, the DONE_IO flag goes high, which allows the SPI controller to initiate 55 SPI read measurements, the first of which is the address, and the other 54 of which are the data. The measurement system then returns to the standby mode.

Figure 21A:
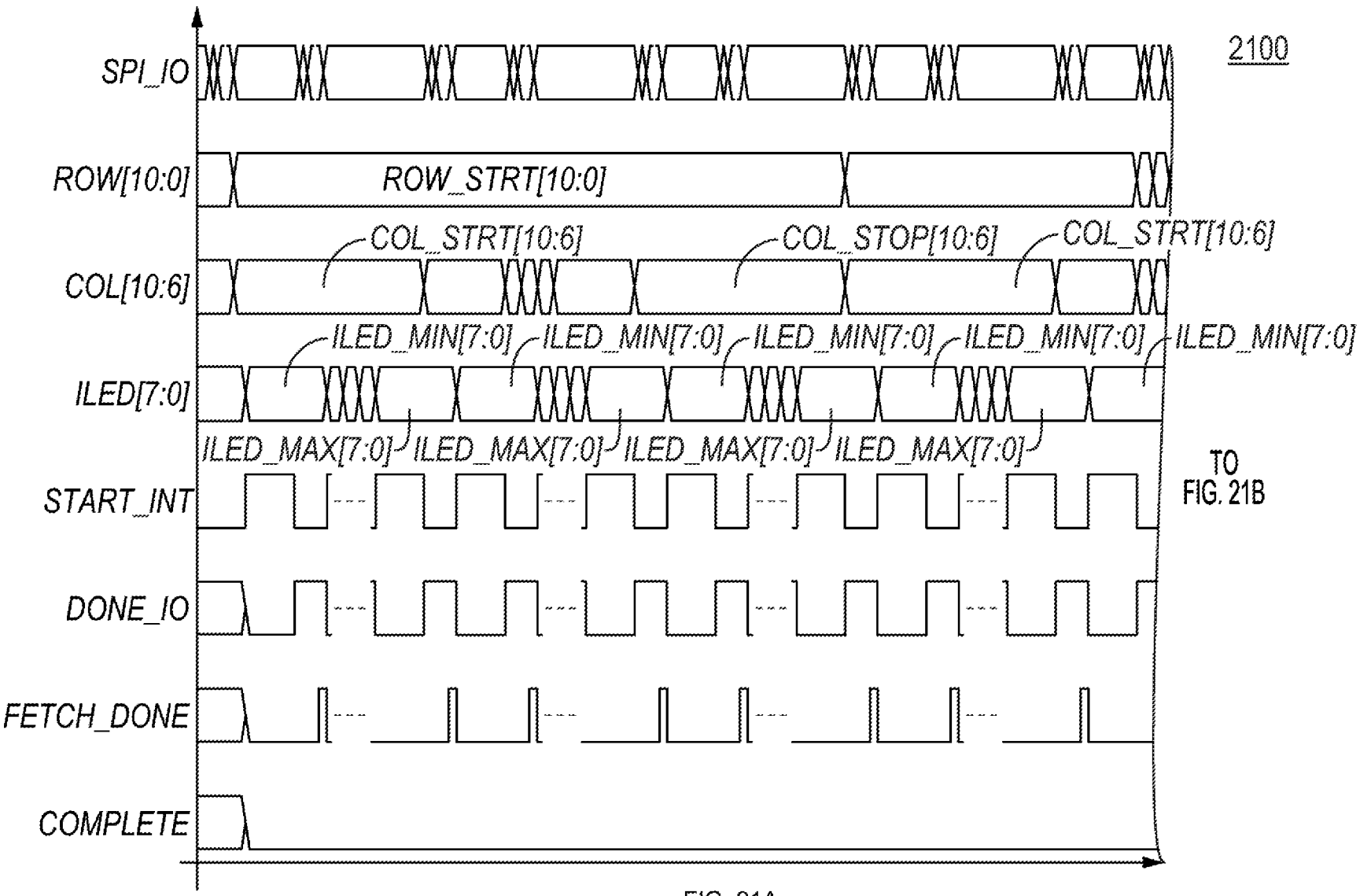
FIGS. 21A and 21B illustrate timing waveforms in the fully automatic mode, where a large number of LEDs, up to an entire array of LEDs, may be measured, according to an embodiment of the disclosure.
Figure 21B:
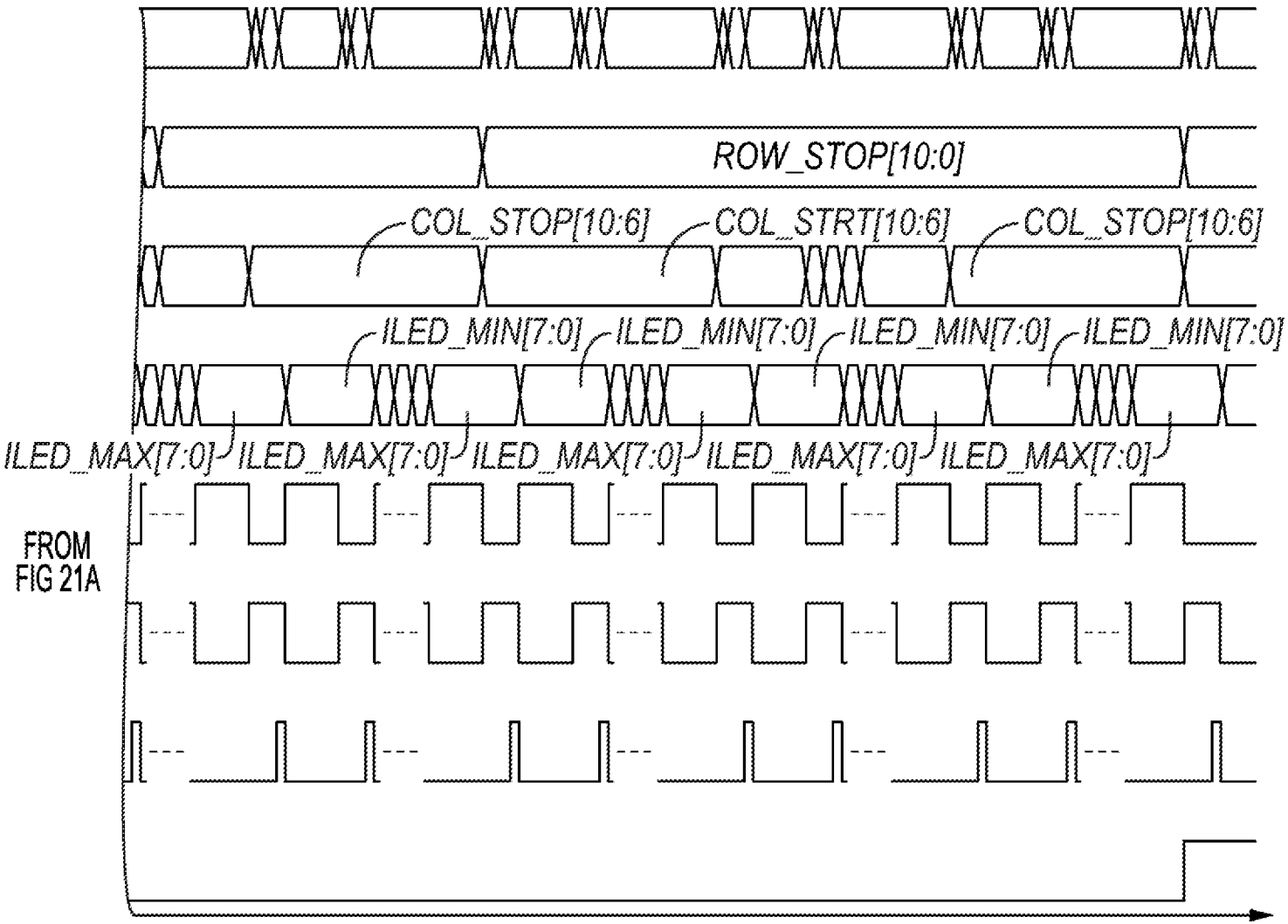

FIGS. 21A and 21B illustrate timing waveforms 2100 in the fully automatic mode, where a large number of LEDs, up to an entire array of LEDs, may be measured according to an embodiment of the disclosure. The timing waveforms 2100 allow the sweep of the LEDs to start anywhere and stop anywhere. The timing waveforms 2100 include, from top to bottom, the SPI_IO, the row address, the column address, the LED bias current set point, the START_INT, the DONE_IO, the FETCH_DONE, and the COMPLETE. The SPI_IO performs an SPI write to set the sweep range, and the START_INT goes high if the START_IO is high, resets the DONE_IO, the FETCH_DONE, and the COMPLETE, and sets the LED bias current. Next the data for a batch of 54 LEDs is acquired and digitized. Once the digitization is complete, a SPI burst begins to fetch the data. Once the SPI burst is complete, the FETCH_DONE resets to zero with the next rising edge of START_INT. In this example, the addressing and the bias current are automatically incremented. The measurement steps through the start and stop range to digitize each LED within the range. Once each measurement is complete, the address and the measured voltage are output.

Figure 22A:
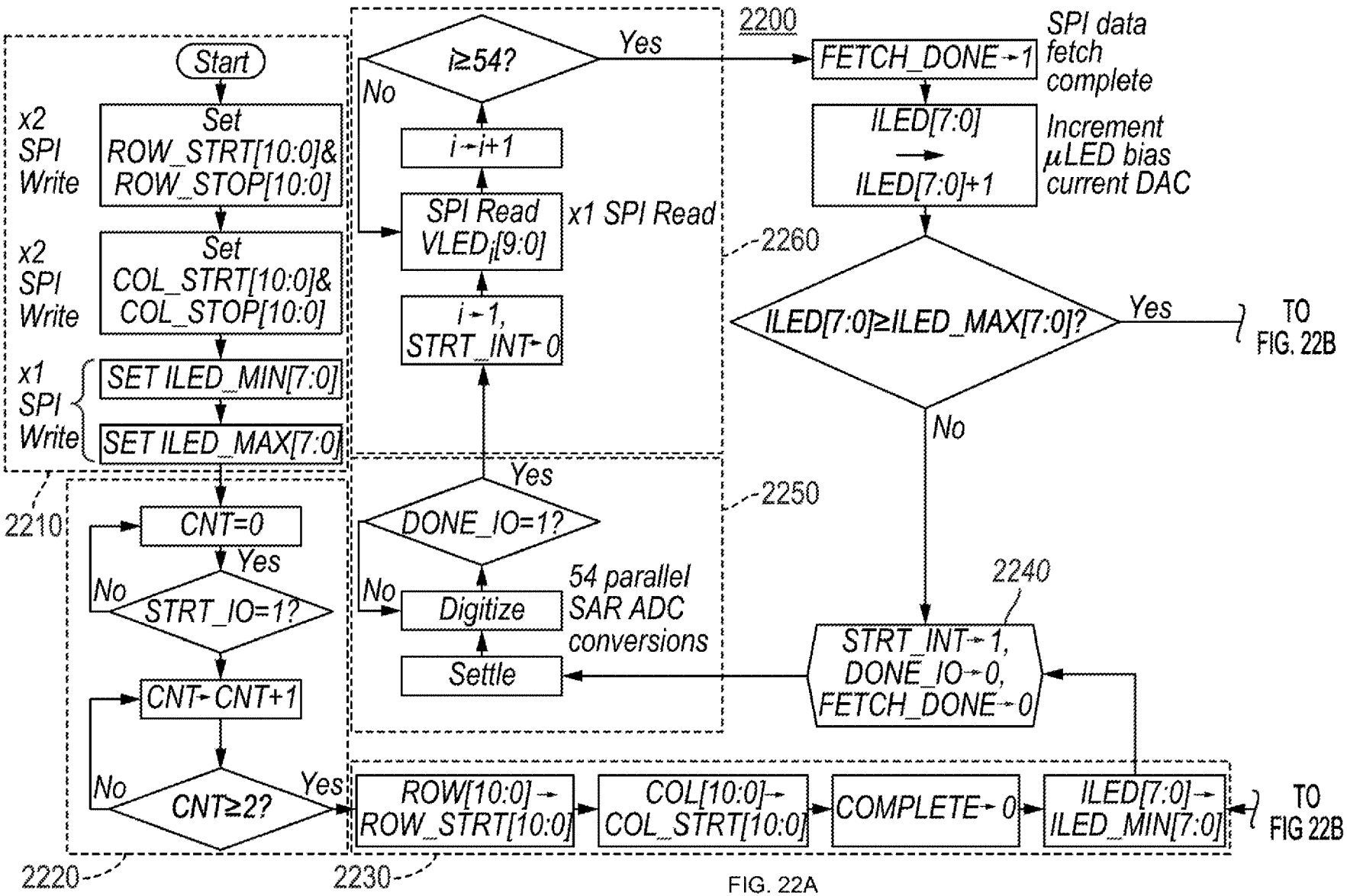
FIGS. 22A and 22B illustrate a flow diagram for the fully automatic mode, according to an embodiment of the disclosure.
Figure 22B:
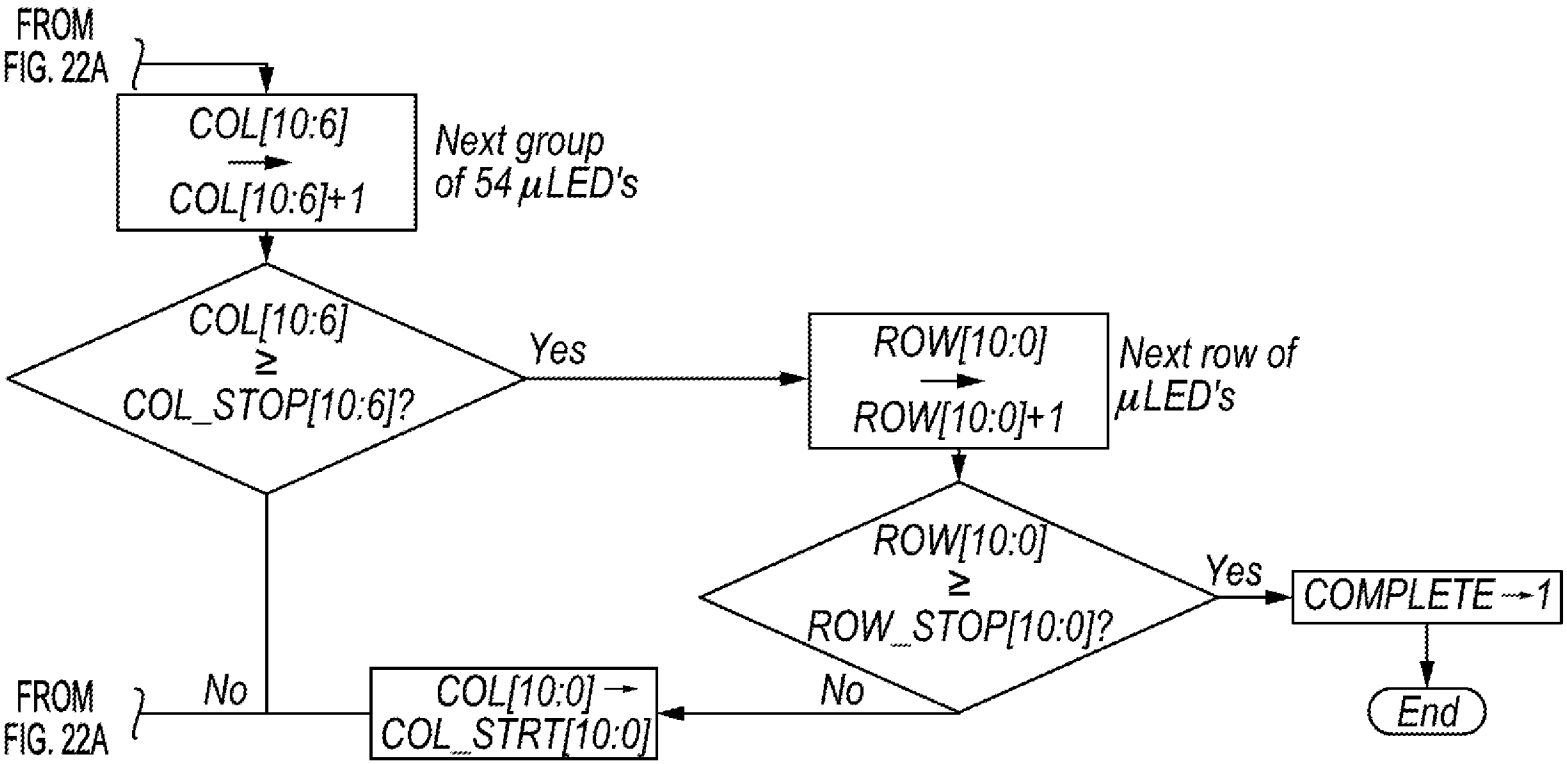

FIGS. 22A and 22B illustrate a flow diagram 2200 for the fully automatic mode, according to an embodiment of the disclosure. The flow diagram 2200 begins at block 2210, where the start and stop measurement addresses and the bias current sweep range are configured via the SPI port. Next the START_IO is monitored at block 2220. Once the START_IO has been high for a predetermined length of time, the sweep is initialized at block 2230, which includes setting the flags and clearing the results from the previous run. The 54 parallel measurements are then triggered at block 2240, and the 54 LEDs are digitized and measured at block 2250. The measurements results are fetched at block 2260.

Figure 23A:
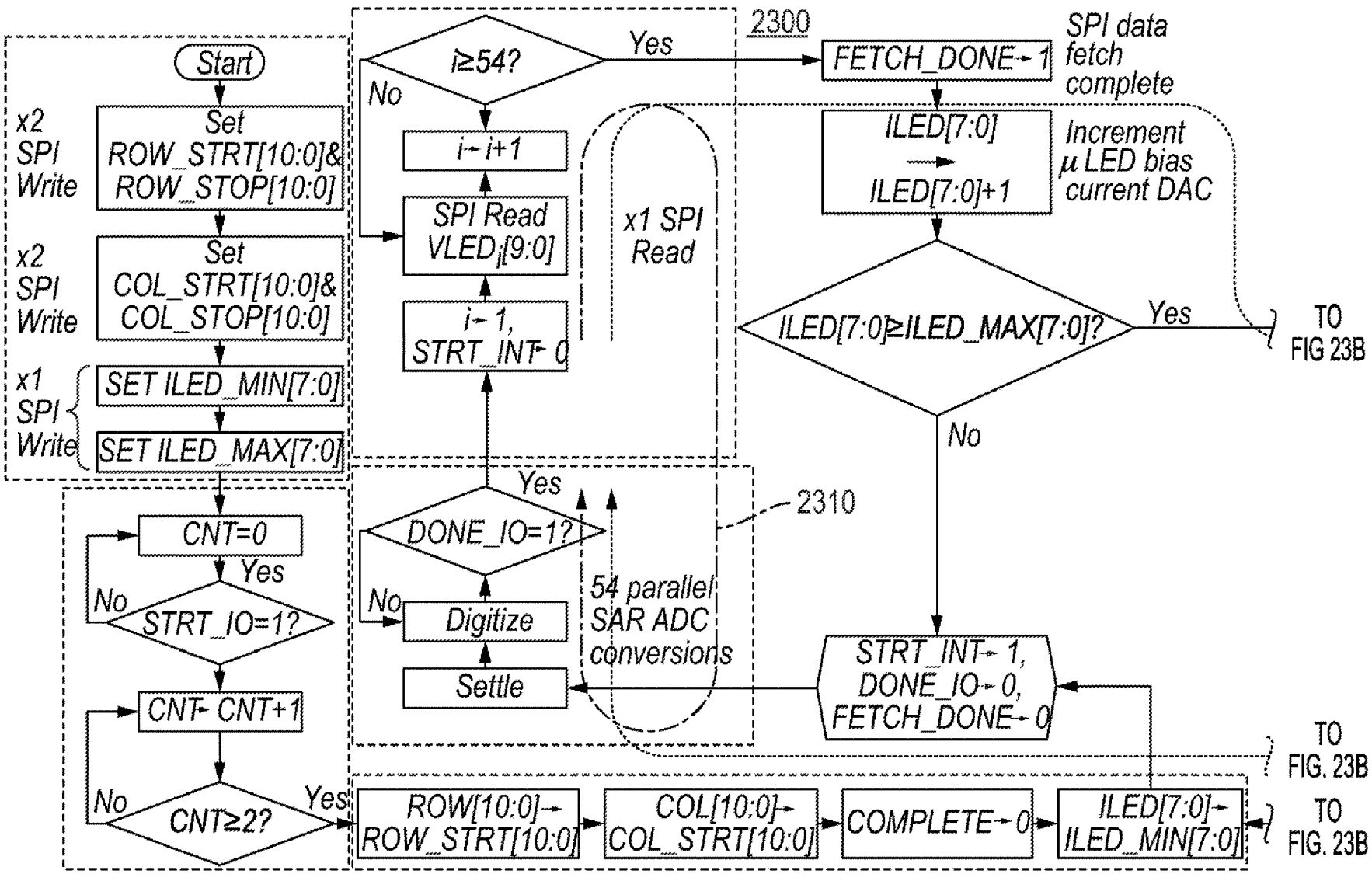
FIGS. 23A and 23B illustrate additional details of the flow diagram for the fully automatic mode, according to an embodiment of the disclosure.
Figure 23B:
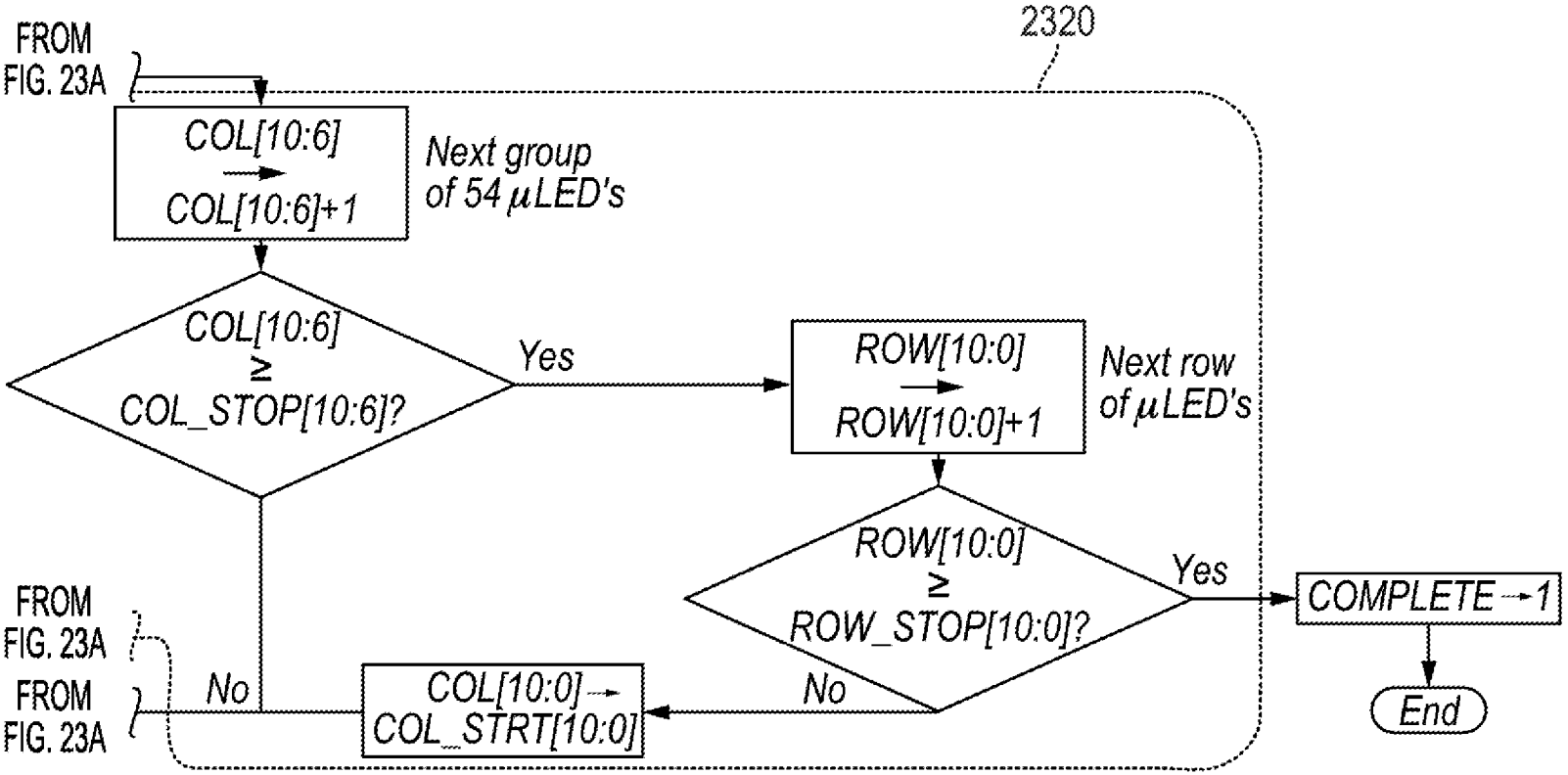

FIGS. 23A and 23B illustrate a flow diagram 2300 for the fully automatic mode, according to an embodiment of the disclosure. The flow diagram 2300 is the same as the flow diagram 2200, but includes separate annotations for clarity. The flow diagram 2300 includes an inner loop 2310 that begins after block 2260 shown in the flow diagram 2200. The inner loop 2310 sweeps the bias current over the specified range. Once the inner loop 2310 is complete, the outer loop 2320 sweeps the address range. Accordingly, the entire array of LEDs (or a subset of the array of LEDs) may be measured automatically.

Figure 24:
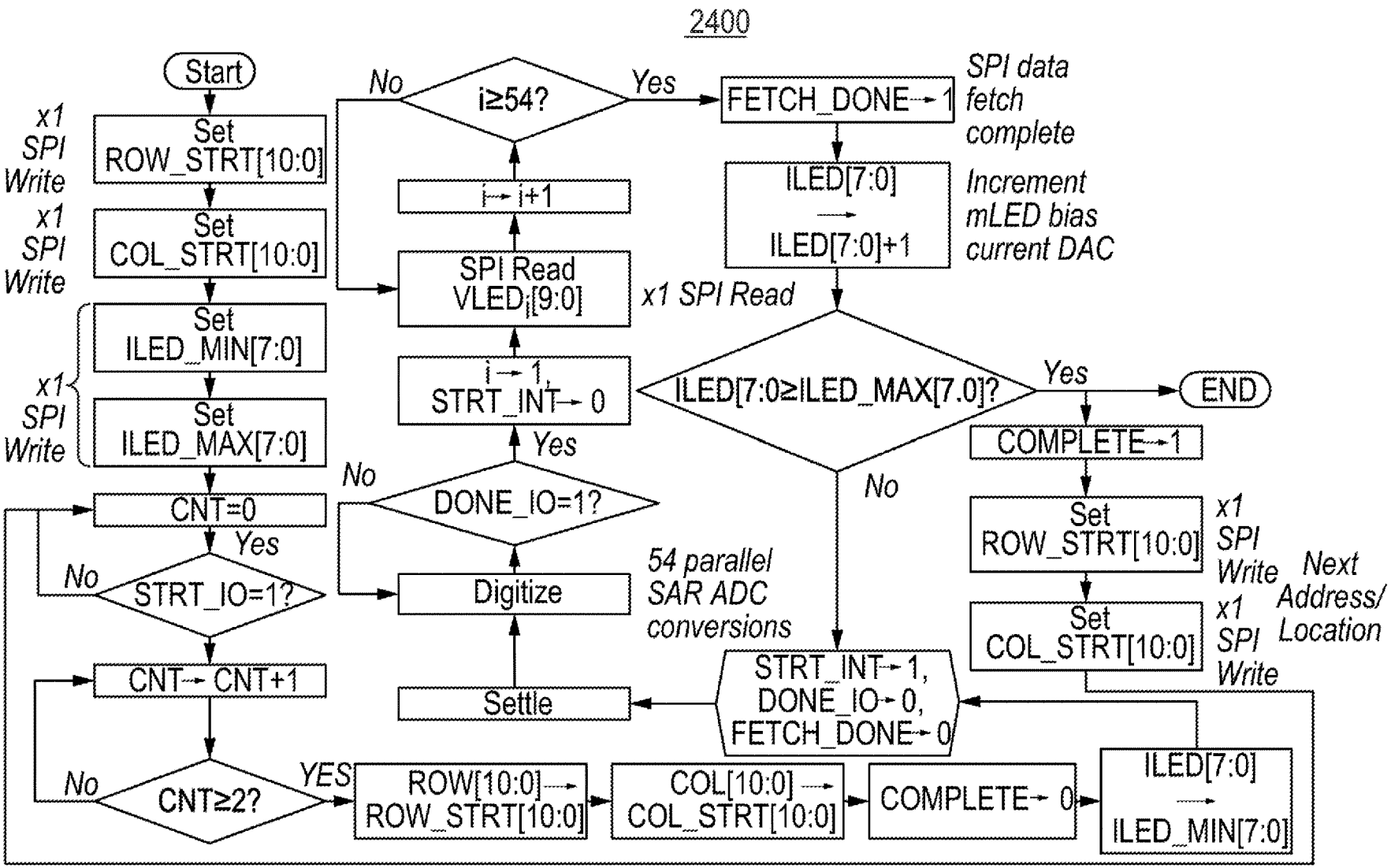
FIG. 24 illustrates a flow diagram for making automatic LI-V measurements on a range of LEDs, up to an entire array of LEDs, according to an embodiment of the disclosure.

FIG. 24 illustrates a flow diagram 2400 for the external trigger mode for making automatic LI-V measurements on a range of LEDs up to an entire array of LEDs, according to an embodiment of the disclosure. The flow diagram 2400 is similar to the flow diagrams 2200 and 2300, but is modified to acquire LI-V measurements and to be controlled by the controller associated with the external light sensor, as discussed above.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus comprising:

a plurality of controllable current sources configurable to generate, in parallel, a plurality of first bias currents, each of a known magnitude, for driving a plurality of light emitting diodes (LEDs) during a first test cycle;

a plurality of measurement circuits configurable to obtain a plurality of first voltage measurements, each indicative of a voltage measurement at one of the plurality of LEDs during the first test cycle, wherein the plurality of controllable current sources are further configurable to generate, in parallel, a plurality of second bias currents, each of a known magnitude, for driving the plurality of LEDs during a second test cycle, wherein the plurality of measurement circuits are further configurable to obtain a plurality of second voltage measurements, each indicative of a voltage measurement at one of the plurality of LEDs during the second test cycle; and a memory device for storing the plurality of first bias currents, the plurality of first voltage measurements, the plurality of second bias currents, and the plurality of second voltage measurements as a current-voltage (I-V) performance characteristic for the plurality of LEDs, wherein the plurality of LEDs are part of a two-dimensional array of LEDs.

2. The apparatus of claim 1, wherein:

the plurality of controllable current sources form a part of a driving circuit backplane; and the two-dimensional array of LEDs is mountable to the driving circuit backplane.

3. The apparatus of claim 2, wherein the plurality of measurement circuits are implemented within the driving circuit backplane.

4. The apparatus of claim 2, wherein the plurality of measurement circuits are implemented outside of the driving circuit backplane and outside of an active array circuit containing the two-dimensional array of LEDs.

5. The apparatus of claim 1, wherein each of the plurality of measurement circuits comprises a buffer and an analog-to-digital converter (ADC).

6. The apparatus of claim 1, wherein each of the plurality of measurement circuits comprises a buffer, a comparator, and a digital-to-analog converter (DAC).

7. The apparatus of claim 1, further comprising one or more multiplexers, wherein the one or more multiplexers are configured to selectively connect the plurality of controllable current sources and the plurality of measurement circuits to selected LEDs in the two-dimensional array of LEDs.

8. The apparatus of claim 1, further comprising a serial peripheral interface (SPI) controller for controlling operations of the plurality of controllable current sources and the plurality of measurement circuits.

9. The apparatus of claim 1, further comprising a plurality of switch transistors, wherein each of the plurality of LEDs is connected to a respective one of the plurality of switch transistors.

10. The apparatus of claim 9, wherein each of the plurality of measurement circuits is connected to at least one of the plurality of switch transistors.

11. The apparatus of claim 10, wherein each of the plurality of measurement circuits is connected to at least one of the first subset of the plurality of LEDs.

12. The apparatus of claim 1, further comprising a plurality of switch transistors, wherein each of a first subset of the plurality of LEDs is connected to a respective one of the plurality of switch transistors, and each of a second subset of the plurality of LEDs is disconnected from a respective one of the plurality of switch transistors.

13. The apparatus of claim 1, wherein each of the plurality of measurement circuits is arranged at a source node of a transistor of a respective one of the plurality of controllable current sources.

14. The apparatus of claim 1, further comprising a light sensor that is configured to obtain a plurality of first luminance measurements from the plurality of LEDs during the first test cycle, and to obtain a plurality of second luminance measurements from the plurality of LEDs during the second test cycle, wherein the memory device is further configured to store the plurality of first luminance measurements, the plurality of first voltage measurements, the plurality of second luminance measurements, and the plurality of second voltage measurements as a luminance-voltage (LI-V) performance characteristic for the plurality of LEDs.

15. The apparatus of claim 14, further comprising a controller that is configured to generate a first trigger signal for the plurality of controllable current sources to generate the plurality of first bias currents for driving the plurality of LEDs during the first test cycle, wherein the first trigger signal is generated as a function of a location of the light sensor with respect to the plurality of LEDs.

16. The apparatus of claim 1, wherein one of the plurality of controllable current sources is configured to generate one of the plurality of first bias currents for driving a subset of the plurality of LEDs during the first test cycle, and to generate one of the plurality of second bias currents for driving the subset of the plurality of LEDs during the second test cycle.

17. The apparatus of claim 1, wherein one of the plurality of controllable current sources is configured to generate a third bias current of a known magnitude for driving each of a subset of the plurality of LEDs in sequence.

18. The apparatus of claim 1, further comprising a port that is configured to receive a start address and a stop address for the plurality of LEDs.

* * * * *